US007908034B2

(12) United States Patent
Gray

(10) Patent No.: US 7,908,034 B2
(45) Date of Patent: Mar. 15, 2011

(54) SYSTEM, PROGRAM PRODUCTS, AND METHODS FOR CONTROLLING DRILLING FLUID PARAMETERS

(75) Inventor: Kenneth E. Gray, Dripping Springs, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 335 days.

(21) Appl. No.: 11/994,320

(22) PCT Filed: Jun. 30, 2006

(86) PCT No.: PCT/US2006/025964

§ 371 (c)(1),
(2), (4) Date: Jun. 18, 2008

(87) PCT Pub. No.: WO2007/005822

PCT Pub. Date: Jan. 11, 2007

(65) Prior Publication Data

US 2009/0194330 A1 Aug. 6, 2009

Related U.S. Application Data

(60) Provisional application No. 60/696,092, filed on Jul. 1, 2005, provisional application No. 60/701,744, filed on Jul. 23, 2005.

(51) Int. Cl.
*G05D 7/00* (2006.01)
*G05D 11/00* (2006.01)

(52) U.S. Cl. ..... 700/282; 175/24; 175/38; 175/40; 175/48

(58) Field of Classification Search ..... 700/282; 175/24, 25, 38, 40, 48
See application file for complete search history.

(56) References Cited

U.S. PATENT DOCUMENTS

| | | | | |
|---|---|---|---|---|
| 5,758,095 | A | 5/1998 | Albaum | |
| 5,933,136 | A | 8/1999 | Brown | |
| 6,587,829 | B1 | 7/2003 | Carmada | |
| 6,904,981 | B2 * | 6/2005 | van Riet | 175/66 |
| 2003/0196804 | A1 * | 10/2003 | Riet | 166/267 |
| 2009/0194329 | A1 * | 8/2009 | Guimerans et al. | 175/17 |

OTHER PUBLICATIONS

"Managing Wellbore Pressure While Drilling", McCaskill et al, PowerWell Services, Mar./Apr. 2006.*
Using Downhole Annular Pressure Measurements to Improve Drilling Performance, Aldred et al, Oilfield Review, Winter 1998.*
"Dynamic Annular Pressure Control System", at balance with Smith, marketing flyer—date unknown.*
"Managed Pressure Drilling", Weatherford, 2008.*
International Search Report dated Apr. 11, 2008 (2 pages).

* cited by examiner

*Primary Examiner* — Michael D Masinick
(74) *Attorney, Agent, or Firm* — Bracewell & Giuliani LLP

(57) ABSTRACT

Embodiments of systems, program products, and methods for controlling drilling fluid parameters are provided. These embodiments, for example, provide dynamic density control with highly adaptive, real-time, process-control and are scalable to any rig, large or small, on land or water. Combined static and dynamic stresses and displacements can be determined continuously at strategic locations in and around the wellbore of a well so that insitu and operational induced pressure window limitations at specific weak-points or other locations of interest are controlled.

35 Claims, 17 Drawing Sheets

22
27
103
109
111
129
28
69
25
18
65
19
101
21
117
71
105
107
113
121
13
63
17
15
125
45
53
37
39
41
43
47
49
51
55
59
57

SYSTEM, PROGRAM PRODUCTS, AND METHODS FOR CONTROLLING DRILLING FLUID PARAMETERS

RELATED APPLICATION

This application claims priority to PCT Application PCT/US2006/025964, International Filing date Jun. 30, 2006 which claims priority to U.S. patent application No. 60/696,092, filed Jul. 1, 2005 and U.S. patent application No. 60/701,744, filed Jul. 23, 2005.

BACKGROUND OF THE INVENTION

1. Field of the Invention

This invention relates in general to well drilling and, in particular, to systems, program products, and methods associated with controlling drilling-fluid parameters in an oil or gas well.

2. Description of the Related Art

More and more oil exploration is moving toward ever challenging environments, which present increasing environmental and technical risks. Such environments are resulting in narrow or margins between the pressure of fluids inside the pores of rock at the bottom of a well hole, known as pore pressure, and the pressure which causes a rock formation containing or adjacent a formation containing desired hydrocarbons to fracture, known as the fracture or leak off pressure of the formation. Well drilling systems can include a drilling rig located substantially at the surface. A drill string positioned within the casings extends through the casings to the formation containing hydrocarbons. The drilling string and annular area between the drilling string and between the wellbore and inner-most casing, referred to as the annulus, form a drilling circulation system.

Primary and intermediate casings (strings) are cemented inside a drilling hole to prevent direct transmission of fluid pressure to intermediate formations. The casing strings are designed for operationally limiting gradients, on the high side for overburden, fracture, borehole stability, etc. and on the low side for pore pressure control and/or wellbore integrity, etc. The overburden gradient is initially quite low and increases in a highly non-linear fashion with depth. Fracture gradient follows a similar trend, with separation from the overburden gradient diminishing with depth. Pore pressure increases with depth, details of which depend upon conditions in each formation penetrated. Separation of the upper limit (overburden or fracture) and lower limiting pore pressure is used to determine the number and depth of casing strings to be run.

As well drilling operations reach into deeper and deeper depths, proper well control becomes ever more challenging and yet more critical. Variations in the density of the drilling fluid resulting in more pronounced changes in hydrostatic pressure at the bottom of the well bore. Further, and deeper depths, some formations may not tolerate significant variations in hydrostatic pressure. Such variations in hydrostatic pressure can result in either a formation fluid influx into the wellbore, known as a "kick," or a loss of drilling fluid to the formation, known as "lost circulation."

Drilling a well bore generally requires circulating a drilling fluid through the drilling fluid circulation system. At the surface, the drilling fluid is pumped through a flowmeter and down the drilling string to the bottom hole of the well and is returned via the annulus. The fluid exits the annulus through a return line, outlet flowmeter or flowmeters, degasser, shale shaker to remove drilling clippings, and into a fluid storage tank to again be pumped down the drilling string. A choke in the return line can be used to control pressure within the annulus.

As the drilling fluid is circulated through the circulation system under a positive pressure from a surface "mud" pump (or bottom hole pump), the drilling fluid encounters a loss in pressure due to friction, known as "circulating friction." The circulating friction is generally the result of an interaction between the drilling fluid and the inner surface of the drilling fluid conductors through which the drilling fluid is circulating. The mud pump and bottom hole circulating pressure is generally kept substantially constant for a particular set of operating parameters. When the drilling fluid is not being circulated, the bottom hole pressure exerted on the formation is a non-circulating or "static" hydrostatic pressure equal to the hydrostatic weight of the drilling fluid column. When drilling and under steady-state conditions, the drilling fluid is circulated and the bottom hole hydrostatic pressure exerted on the formation is increased above the non-circulating or "static" hydrostatic pressure by the amount of friction pressure in the well bore annulus. The resulting bottom hole pressure applied to the formation when circulating drilling fluid is known as the equivalent circulating density or "ECD."

The drilling fluid is utilized to provide hydrostatic well control. In overbalanced drilling the weight of the drilling fluid and the setting of the choke is selected so that the dynamic pressure at the lower ends of the drilling and casing strings are greater than the pore pressure, but less than the fracture or leak off pressure. In near balanced drilling the dynamic pressure is maintained approximately the same as the pore pressure. In under balanced drilling, the dynamic pressure is maintained less than the pore pressure. In each type of drilling, the dynamic pressure is maintained by a combination of the drilling fluid weight (density) and control of the choke via surface well control equipment.

In order to determine if a "kick" is being encountered or if there is lost circulation, mass flow and/or volume flow can be monitored both in and out of the system to detect an influx or loss of mass or volume of the drilling fluid or by means of downhole temperature sensors, downhole hydrocarbon sensors, pressure chain sensors, or pressure pulse sensors. A discrepancy between predicted and monitored flow out can be indicative of an influx into or loss of the drilling fluid. The difference in mass being supplied to the drilling string and returned from the well annulus provides an indication of whether or not fluid is entering or exiting downhole. If a discrepancy is detected, the bottom hole pressure is controlled by a process known as managed pressure drilling.

Most recent developments in drilling systems include those described in U.S. Pat. No. 6,352,129 by Best titled "Drilling System," U.S. Pat. No. 6,374,925 by Elkins et al. titled "Well Drilling Method and System," U.S. Pat. No. 6,484,816 by Koederitz titled "Method and System for Controlling Well Bore Pressure," and WIPO Patent Document No. WO 02/50398 A1 by Leuchtenberg titled "Closed-Loop Fluid Handling System for Well Drilling."

According to one methodology, weighing agents, e.g., barite, are added to the drilling fluid to increase the "weight" in response to influx or oil or other low density material is added to the drilling fluid in response to fluid loss to set a desired drilling fluid density to change the equivalent circulating density and bottom hole pressure. This methodology is extremely inefficient as hours may pass as the weighing agent is being added to the drilling fluid and circulated through the circulation system. Another methodology of adjusting bottom hole pressure in response to an influx or drilling fluid loss includes adjusting the fluid choke in the fluid output conductor when circulating the drilling fluid and/or when drilling to apply sufficient back pressure. Another methodology of adjusting bottom hole pressure includes injecting fluid into the annulus when not performing drilling.

In order to function, each methodology incorporates assumptions used in monitoring pressure, volume, and density entering and exiting the circulation system and in determining desired drilling fluid density adjustment parameters or choke configuration parameters. These assumptions include the drilling fluid being a single-phase liquid that is incompressible. The assumptions also include the mud pump pressure being substantially constant. The assumptions further include that the flowrate of the drilling fluid entering the drilling string from the surface, although adjustable, is substantially constant. In the latter two methodologies, these assumptions also include that the density, although adjustable, is substantially constant.

Methodologies employed in the state-of-the-art for managing bottom hole pressure, general known as managed pressure drilling, do not account for, i.e., ignore, the pressure changes inside the drilling string along with other significant factors in the whole system that contribute in substantial ways to operational effects in the annulus, at the choke, at the bottom of the hole. Previously employed methodologies do not account for the compressibility of associated rocks, fluid in the rocks, cement in the hole, the casing strings cemented in the hole, the drilling fluid, the drilling string assembly when drilling, which is an enormous volume of material. The volume to pressurize the circulation system is small but it is not zero. Additionally, recognized by the Applicant is that adjusting the choke in the output line adjusts annulus pressure, but not necessarily pressure within the drilling string.

Therefore, there is still a need for a system, program product, and methods for enhanced dynamic control of drilling fluid pressures and parameters. Particularly, recognized by the Applicant is the need for a system that can monitor and control pressure, volume, density, temperature, fluid composition, molecular concentration of both single phase and multiphase drilling fluid both when entering and when exiting the drilling circulation system and at any location from the surface and along the length inside the drilling string and in the annulus, i.e., either side of the U-tube, at any time or operational drilling phase. Recognized also is the need for a system that can account for the pressure changes and other factors inside the drilling string, in the annulus, at the choke, at the bottom of the hole, and that can account for the volume of drilling fluid required to pressurize the circulation system. Recognized also is the need for a system that can measure compressibility of associated rocks, fluid in the rocks, cement in the hole, the casing strings cemented in the hole, the drilling fluid, the drilling string assembly to formulate a running description of the physical behavior of the drilling system and all components, and that can account for such compressibility to thereby enhance dynamic density control throughout the system. Recognized also is the need for a system that can account for friction losses for any location for any rheology and physical dimensions of the circulation system and that can determine and compensate for the existence of mud channels in the drilling string cement. Recognized further is the need for a system that can dynamically manipulate the mud weight window, and that can predict maximum dynamic bottom hole pressure at future depths to be drilled to thereby anticipate future drilling requirements to drill at the future depth including a requirement to order supplies, people, third party services, etc. Recognized further, also, is the need for a system that can add gas or other fluids to drilling fluid and account for gas or other fluids added in the drilling fluid.

SUMMARY OF THE INVENTION

In view of the foregoing, embodiments of the present invention provide systems, program products, and methods to enhance the controlling of drilling fluid pressures and other parameters such as in an oil or gas well. Embodiments of systems, program products, and methods for controlling drilling pressures of the present invention, for example, advantageously provide dynamic density control (DDC) and dynamic mud weight windows (DMWW). These embodiments having DDC provide highly adaptive, real-time, process control and can be scalable to any rig, large or small, on land or water. Embodiments of systems, program products, and methods also advantageously allow combined static and dynamic stresses and displacements to be determined continuously at strategic locations in and around the wellbore so that insitu and operationally induced pressure window limitations at specific weal-points are controlled. By coupling feedback loops and high-rate, high-quality, time-lapse data logging, for example, embodiments of the present invention allow an operator/service company team to "walk-the-line" or even "move-the-line".

For example, mass and energy balances for an active system account for time-varying bulk volumes, stresses, pressures, fluids, and temperatures, coupled and associated with flows, displacement or movement. On or off switching circuitry can activate individual system element quantifiers in isolation or coupled with other elements to allow selected usage, maximum usage, or no usage of the enhanced system features. An embodiment of a method of controlling drilling fluid pressures includes monitoring the fluid pressure in real-time and increasing fluid head pressure within a drill pipe and annulus of a well to thereby control downhole pressures within pre-selected limits.

Additionally, many applications for embodiments of systems, program products, and methods of the present invention abound. For example, applications can include detecting pressure changes where critical pressure magnitudes and small pressure tolerances have large economic, technical, safety, and environmental consequences; in distinguishing between kicking flow and ballooning flow in kick/loss scenarios; in minimizing formation damage during drilling/completion operations; in identifying likely trouble spots in advance; and in training, predictive, what-ifs, and case studies.

More specifically, according to an embodiment of the present invention, provided is a system for controlling drilling fluid parameters. The system can include a drilling apparatus having one or more casing string cemented within a subterranean wellbore, a drilling string run within the one or more casing strings, an annulus formed between an external surface of the drilling string and inner surface of the innermost casing string, a drilling fluid inlet, a drilling fluid outlet, a drilling fluid circulating through the drilling fluid inlet, down through the drilling string, up through the annulus, and out the drilling fluid outlet, one or more monitors including one or more sensors positioned to monitor drilling fluid parameters of the drilling fluid entering the drilling string, one or more monitors including one or more sensors positioned to monitor drilling fluid parameters of the drilling fluid exiting the annulus, and an output port choke in communication with the annulus and the drilling fluid outlet. A combination of the wellbore and the one or more casing strings have a plurality of locations of interest located at laterally separate locations which must be managed through control of the drilling fluid. The system can also include a dynamic density control computer in communication with the choke and including a processor and memory associated with a processor to store operating instructions therein, and dynamic density control program product stored in the memory of the dynamic density control computer. The dynamic density control program product can include instructions that when executed by the processor of the dynamic density control computer cause the computer to perform the operations of determining separately for each of the plurality of laterally separated locations of interest drilling fluid control variable system limitation of a drilling fluid control variable, measuring a value of an operationally induced drilling fluid parameter at each of a plurality of separate locations when drilling, predicting separately for each of the plurality of laterally separated locations of interest a value of the drilling fluid control variable responsive to each measured drilling fluid parameter value, and controlling a drilling fluid parameter responsive to each predicted control variable value and each associated at least one drilling fluid control variable system limitation.

Embodiments of the present invention can also include methods of controlling drilling fluid parameters. A method, for example, can include determining separately for each of a plurality of laterally separate locations of interest in a drilling system having at least one casing string cemented in a wellbore and a drilling string positionable therethrough at least one drilling fluid control variable system limitation of a drilling fluid control variable, measuring a value of an operationally induced drilling fluid parameter at each of a plurality of separate locations when drilling, predicting separately for each of the plurality of laterally separated locations of interest a value of the drilling fluid control variable responsive to each measured drilling fluid parameter value, and controlling a drilling fluid parameter responsive to each predicted control variable value and each associated at least one drilling fluid control variable system limitation.

Embodiments of the present invention can also include a computer readable medium that is readable by a computer controlling drilling fluid parameters, e.g., pressures, etc., in a drilling system. A computer readable medium, for example, can include a set of instructions that, when executed by the computer, cause the computer to perform the operations of determining separately for each of a plurality of laterally separate locations of interest in a drilling system having at least one casing string positioned in a wellbore and a drilling string positionable therethrough at least one drilling fluid control variable system limitation of a drilling fluid control variable, measuring a value of an operationally induced drilling fluid parameter at each of a plurality of separate locations when drilling, predicting separately for each of the plurality of laterally separated locations of interest a value of the drilling fluid control variable responsive to each measured drilling fluid parameter value, and controlling a drilling fluid parameter responsive to each predicted control variable value and each associated at least one drilling fluid control variable system limitation.

Advantageously, embodiments of the present invention provide a system, program product, and methods that can monitor and control pressure, volume, density, temperature, fluid composition, molecular concentration of both single phase and multiphase drilling fluid both when entering and when exiting the drilling circulation system and at any location from the surface and along the length inside the drilling string and in the annulus, i.e., either side of the U-tube, at any time or operational drilling phase. The system, program product, and methods advantageously can account for the pressure changes and other factors inside the drilling string, in the annulus, at the choke, at the bottom of the hole, and can account for the volume of drilling fluid required to pressurize the circulation system. The system, program product, and methods can measure compressibility of associated rocks, fluid in the rocks, cement in the hole, the casing strings cemented in the hole, the drilling fluid, the drilling string assembly to formulate a running description of the physical behavior of the drilling system and all components, and can account for such compressibility to thereby enhance dynamic density control throughout the system. Further, the system, program product, and methods advantageously can account for friction losses for any location for any rheology and physical dimensions of the circulation system, and can determine and compensate for the existence of mud channels in the drilling string cement. Such system, program product, and methods can dynamically manipulate the mud weight window, and can predict maximum dynamic bottom hole pressure at future depths to be drilled to thereby anticipate future drilling requirements to drill at the future depth including a requirement to order supplies, people, third party services, etc. Embodiments of the present invention can utilize surface parameters, e.g., flow rates, pressures, densities, fluid compositions (in and out); system parameters, e.g., flow rates, pressures, densities, friction losses, temperature distributions of the drilling fluid, to predict operational parameters of the drilling fluid to thereby control drilling fluid parameters. Additionally, embodiments of the present invention can utilize gas volume and solubility profiles in system, and can determine fracture volumes with pressure-volume-time curves/solubility data for the drilling fluids determined by testing or in real-time during operations. Embodiments of the present invention can also incorporate compressibility and load/displacement rules or qualifications (all elements) and strategic space and time derivatives to enhance control.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION OF THE INVENTION

Figure 1:
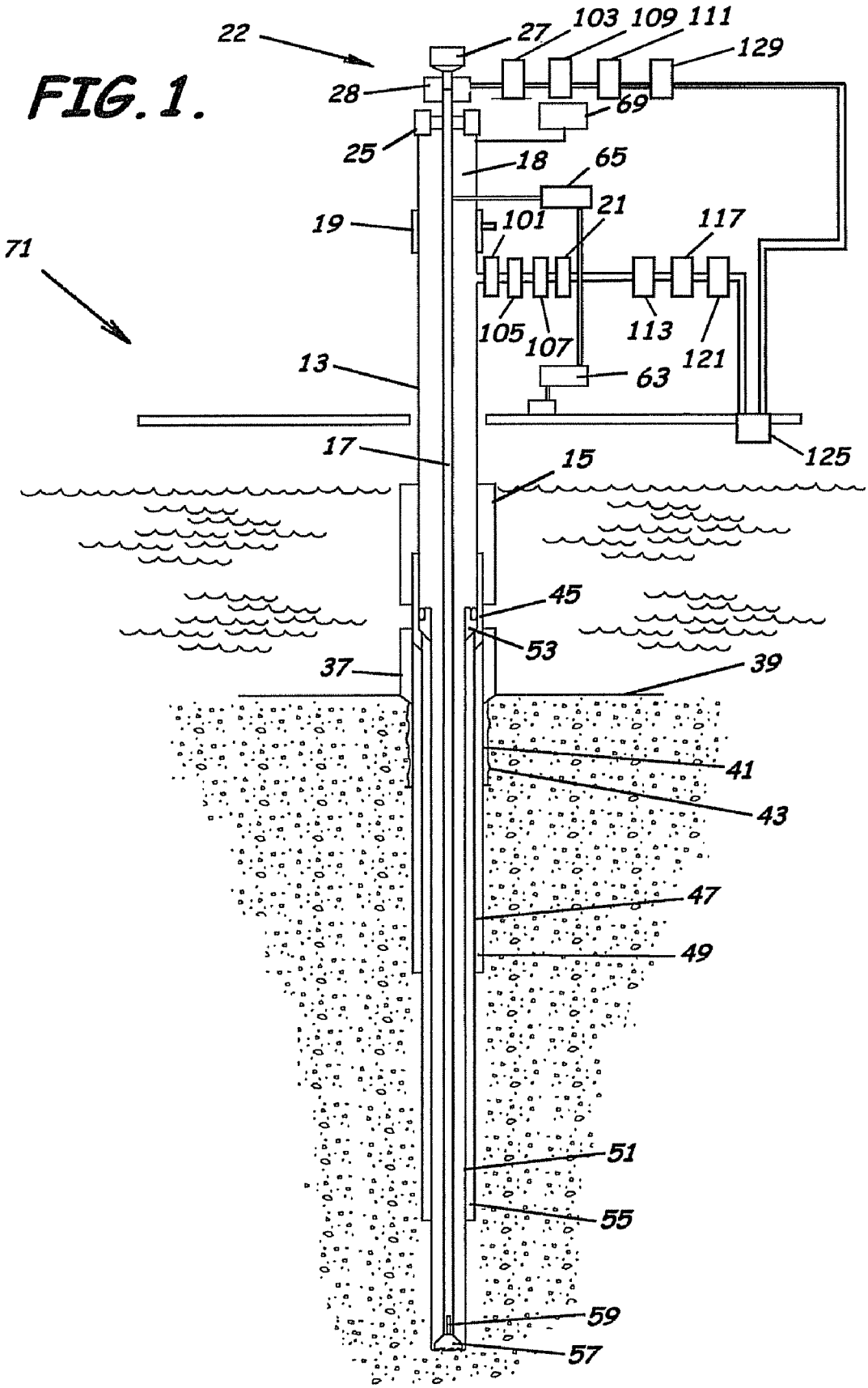
FIG. 1 is a schematic diagram of drilling equipment for use with embodiments of a system for controlling drilling fluid parameters according to an embodiment of the present invention.

The present invention now will be described more fully hereinafter with reference to the accompanying drawings in which embodiments of the invention are shown. This invention, however, may be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout, and prime or double prime notation where used in association with numbers indicates like elements in alternative embodiments.

FIGS. 1 and 2A-2C, the method of this invention illustrate embodiments of a system 22 and method of the present invention in connection with an offshore platform 11. The invention, however, is also applicable to land well drilling operations. The equipment utilized for drilling offshore well 71 in accordance with this embodiment of a system 22 and method may include a drilling riser 13 that is supported by tensioners (not shown) mounted to platform 11. The drilling riser 13 has a lower marine riser package 15 at its lower end. The lower marine riser package 15 has pressure control equipment such as an annular blowout preventer that will close around drill pipe or fully close, pipe rams that will close around pipe, and blind rams that will fully close the drilling riser 13. A string of drill pipe 17 is shown extending through the drilling riser 13.

A rotating control head (RCH) 25 mounts to the upper end of the drilling riser 13. The RCH 25 has a rotatable annular seal member that seals around and rotates with the drill pipe 17. The drill pipe 17, for example, can be rotated by a top drive assembly 27 shown schematically in FIGS. 1 and 2A, a rotary table (not shown), or other similar device known to those skilled in the art. The unit can have a continuous circulation device 28 that allows drilling fluid circulation to continue while breaking out and making up the threaded joints of the drill pipe 17. The drilling pipe 17 has an inlet end that can include an analog or digital sensor or monitor 103 to measure various parameters such as, for example, pressure, flow rate, density, temperature, fluid composition, and gas chromatograph information, e.g., molecular composition of the drilling fluid, in a real-time basis as understood by those skilled in the art (see FIGS. 2A and 3). Fluid, as understood by those skilled in the art, can mean liquid fluids, or gas fluids, or a combination of both.

Figure 2A:
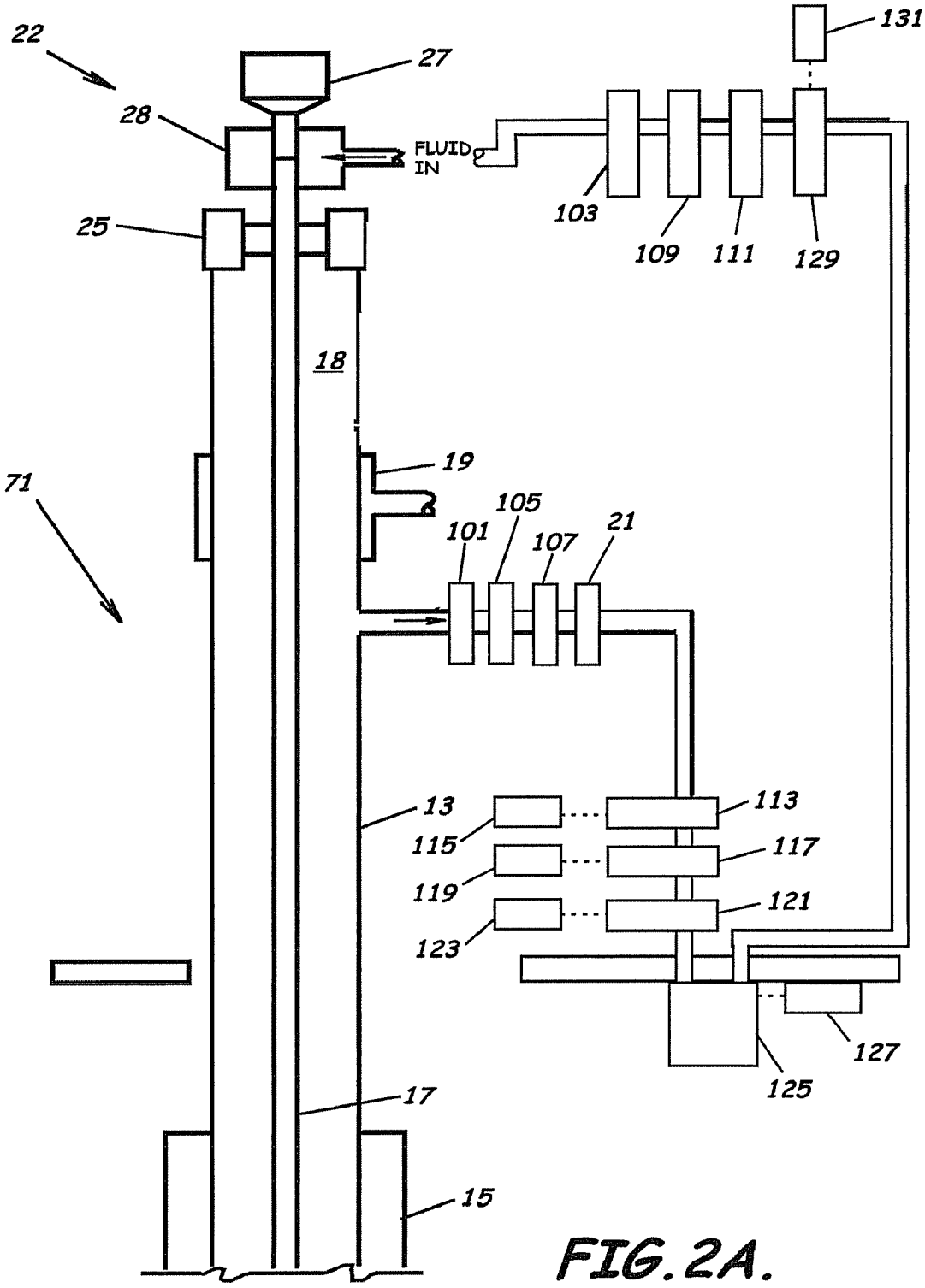
FIGS. 2A-2C are schematic diagrams of drilling equipment according to an embodiment of the present invention.
Figure 2B:
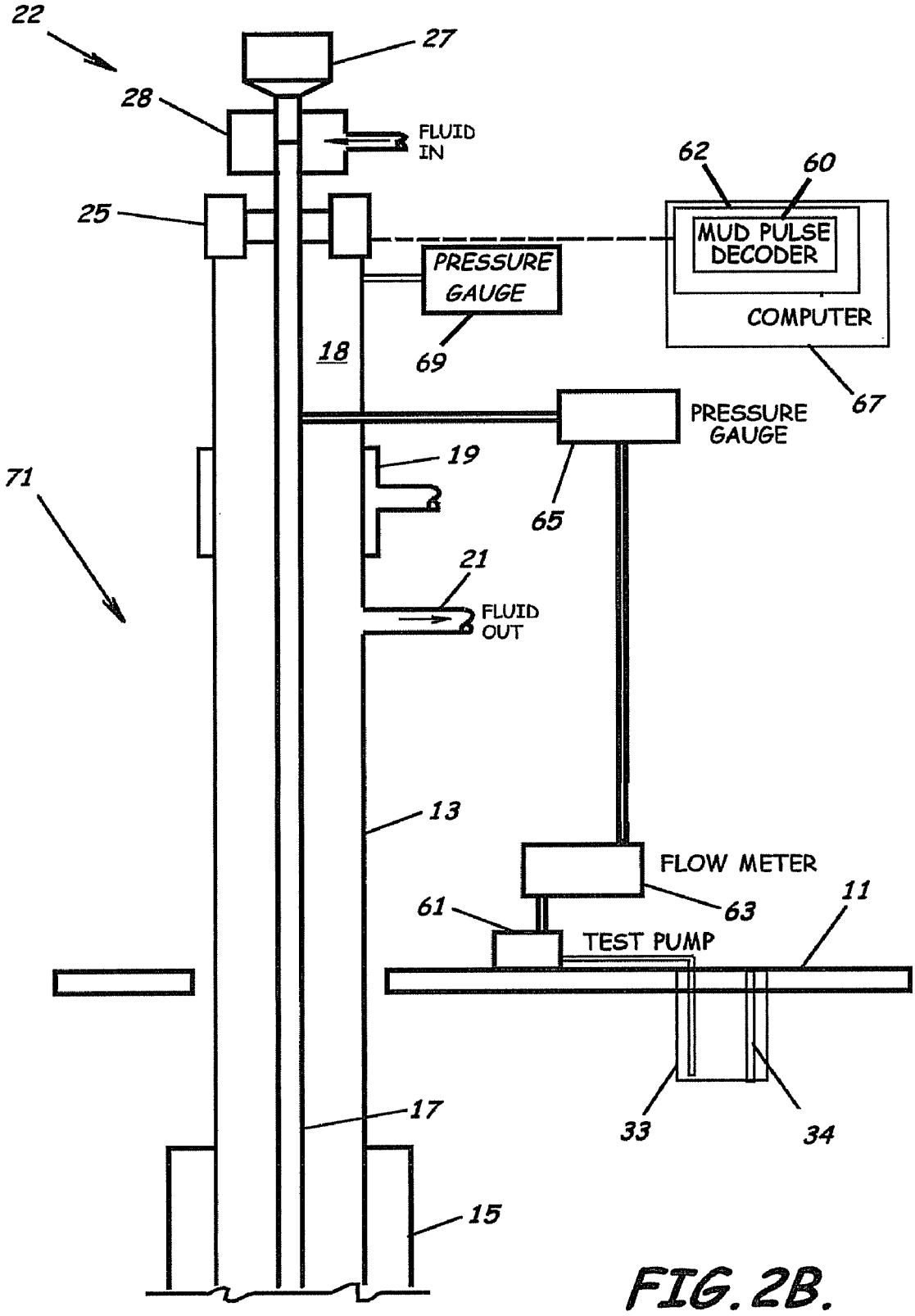
Figure 2C:
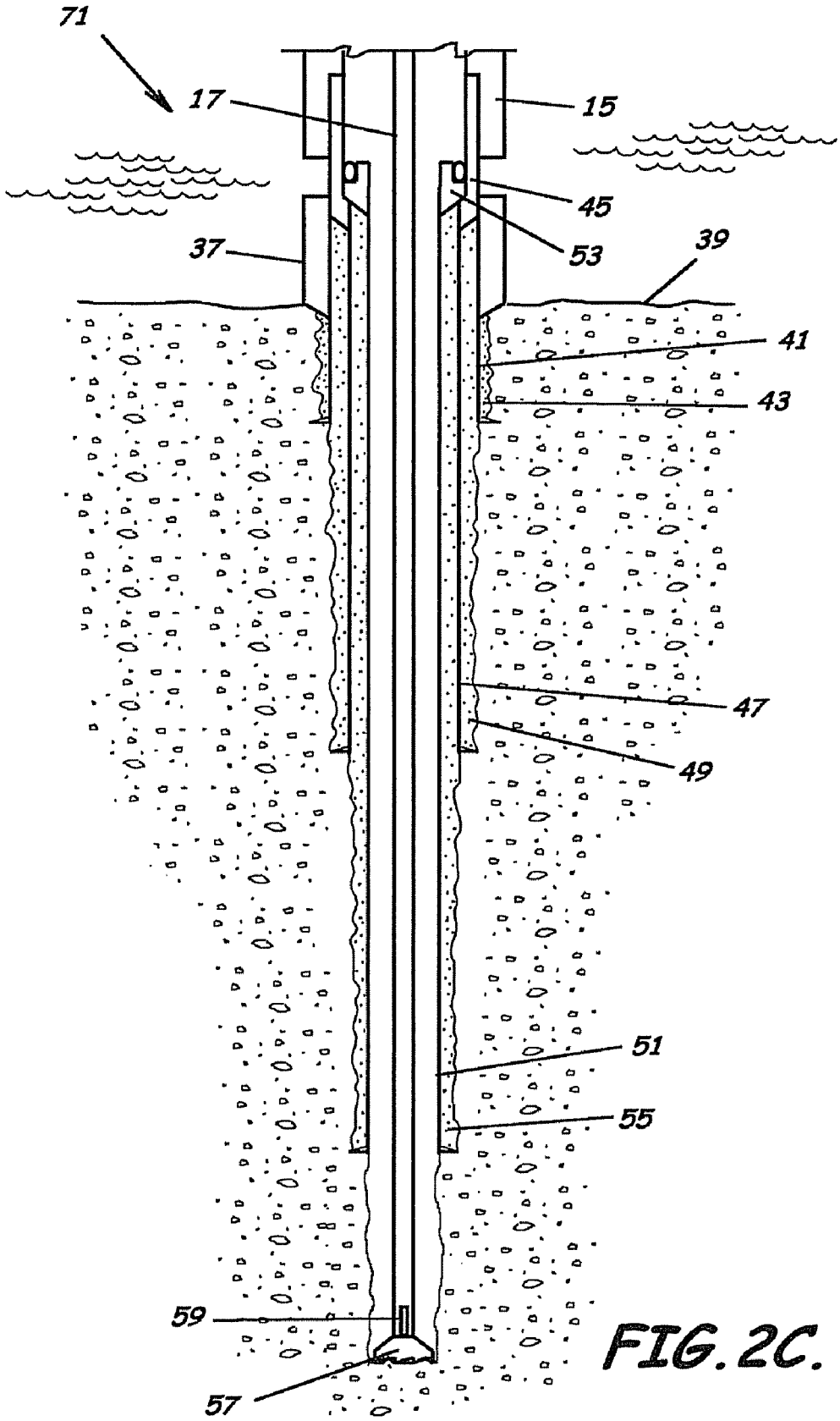

As shown in FIGS. 1 and 2C, for example, a subsea low pressure wellhead housing 37 is at the upper end of the well 71 at the sea floor 39. The low pressure wellhead housing 37 is located at the upper end of the conductor pipe 41 that extends to a first depth in the well 71. The conductor pipe 41 can be cemented in place as indicated by the numeral 43. A high pressure wellhead housing 45 lands in the low pressure wellhead housing 37. A string of casing 47 extends from the lower end of high pressure wellhead housing 45 to a second depth in the well. The casing 47 is cemented in place as indicated by the numeral 49. Another string of casing 51 is shown installed in the well. The casing 51 is supported by a casing hanger 53 that lands within the high pressure wellhead housing 45. The casing 51 is cemented in place as indicated by the numeral 55.

FIGS. 1 and 2C also show a drill bit 57 attached to the lower end of drill string 17 in the process of drilling on open hole below the lower end of casing 51. A measuring while drilling (MWD) instrument or logging while drilling (LWD) instrument 59 (see also FIGS. 3-5) can be mounted in the drill string 17 a short distance above the drill bit 57 for making various measurements and sending those measurements to the surface via fluid pulse techniques. As understood by those skilled in the art, the MWD or LWD instrument 59 can be capable of measuring the bottom hole pressure and sending signals to a pulse decoder 60 of a process control system 62 (see FIGS. 2B and 3) at the surface while drilling fluid is being circulated down drill string 17. A pressure gauge 69 monitors pressure within the drilling riser 13 near the RCH 25 and transmits that information to one or more computers 67. As understood by those skilled in the art, other surface measurements can be made in conjunction with the other measurements, including various parameters relating to each layer or stratae of earth formation, the pore fluid quantifications within each layer or stratae of earth formation, each string of casing, each layer of cement, as well as the fluid or mud within the drilling pipe 17 and annulus 18, which can also be included in the computer(s) 67. These parameters can be measured by a logging tool, logging while drilling (LWD) instrument 59, or other suitable instrument.

An additional string of casing (not shown) or a liner, for example, can be installed when the open hole section shown in FIG. 1 has reached its desired depth. The additional string of casing may be supported by a casing hanger above the casing hanger 53 in the wellhead housing 45. If a liner is employed, it can be suspended by a liner hanger mechanism near the lower end of casing string 51 as understood by those skilled in the art. The number of casing strings will differ from well to well based on depth and characteristics of the earth formations.

As shown in FIGS. 1, 2A, and 2B, the equipment typically includes surface pressure control equipment 19 suspended by the platform 11. The surface pressure control equipment 19 has the capability of closing around the drill pipe 17 and diverting drilling fluid up through diverter lines (not shown) if excessive pressure in the annulus 18 surrounding the drill pipe 17 is encountered. The surface pressure control equipment 19 can also be able to fully close the riser 13 in the absence of the drill pipe 17. The fluid is generally understood to be any material that is capable of residing in the pipe, which can include such materials as mud, gases, entrained fluids residing within the mud, cuttings, and other various types of materials, either alone or in combination, which may flow through the drill pipe 17 and the annulus 18.

The drilling equipment at the outlet end of annulus 18 can include an analog or digital sensor or monitor 101 as understood by those skilled in the art can include one or more sensors or a sensor array. The sensor or monitor 101 can measure a variety of parameters such as, for example, pressure, flow rate, density, temperature, fluid composition, and gas chromatograph information in a real-time basis. The outlet end also can include a mixing chamber 105 from which to mix and an injection pump 107 to inject other fluids to the existing fluid or mud at the annulus 18. The outlet end can also include an output choke 21 at the outlet of the riser 13 for drilling fluid returns from the drill pipe annulus 18. The output choke 21 is a conventional device that restricts the flow of drilling fluid, affecting pressure within the drilling riser 13 in the drill pipe annulus 18 and inside the drill pipe 17. The output choke 21 has a drive mechanism that can vary the orifice within the choke 21 to selectively increase and decrease the pressure in the drill pipe 17 and the drill pipe annulus 18. As illustrated in the embodiment of a system, program product, and a method exemplified in FIG. 3, the solid lines connote fluid transfer or transmittal, and the dashed lines connote data transfer or transmittal. Additionally, in FIG. 3, a single arrow indicates a one directional flow or transmittal, and a double arrow indicates dual directional flow or transmittal. The dual arrow indicators can be, for example, in the form of back pressure as pertaining to fluids, or in the form of a feedback loop as pertaining to data.

The drilling fluid passes through the choke 21 and through the sensors 101 to processing equipment for cleaning and conditioning the fluid, such as a mud/gas separator 113 including, e.g., a gas chromatograph 115, a set of shale shakers 117, and perhaps other devices. Shakers 117 screen and remove cuttings from the drilling fluid for analysis, such as shown by box 119. A fluid treatment device 121 can treat the fluid with a variety of treatments.

The drilling fluid flows into a fluid pit 125, which has a level sensor, a flow rate monitor, a pressure gauge, and a density monitor such as indicated in box 127 and as understood by those skilled in the art. The fluid injection pump 109 draws fluid from the fluid pit 125 through, for example, a mixing chamber 111, and delivers the fluid through a number of digital or analog sensors or monitors 103 to test or analyze various parameters in a real-time basis, and then flows the fluid into the interior of the drill pipe 17 via, e.g., the top drive 27.

Figure 3:
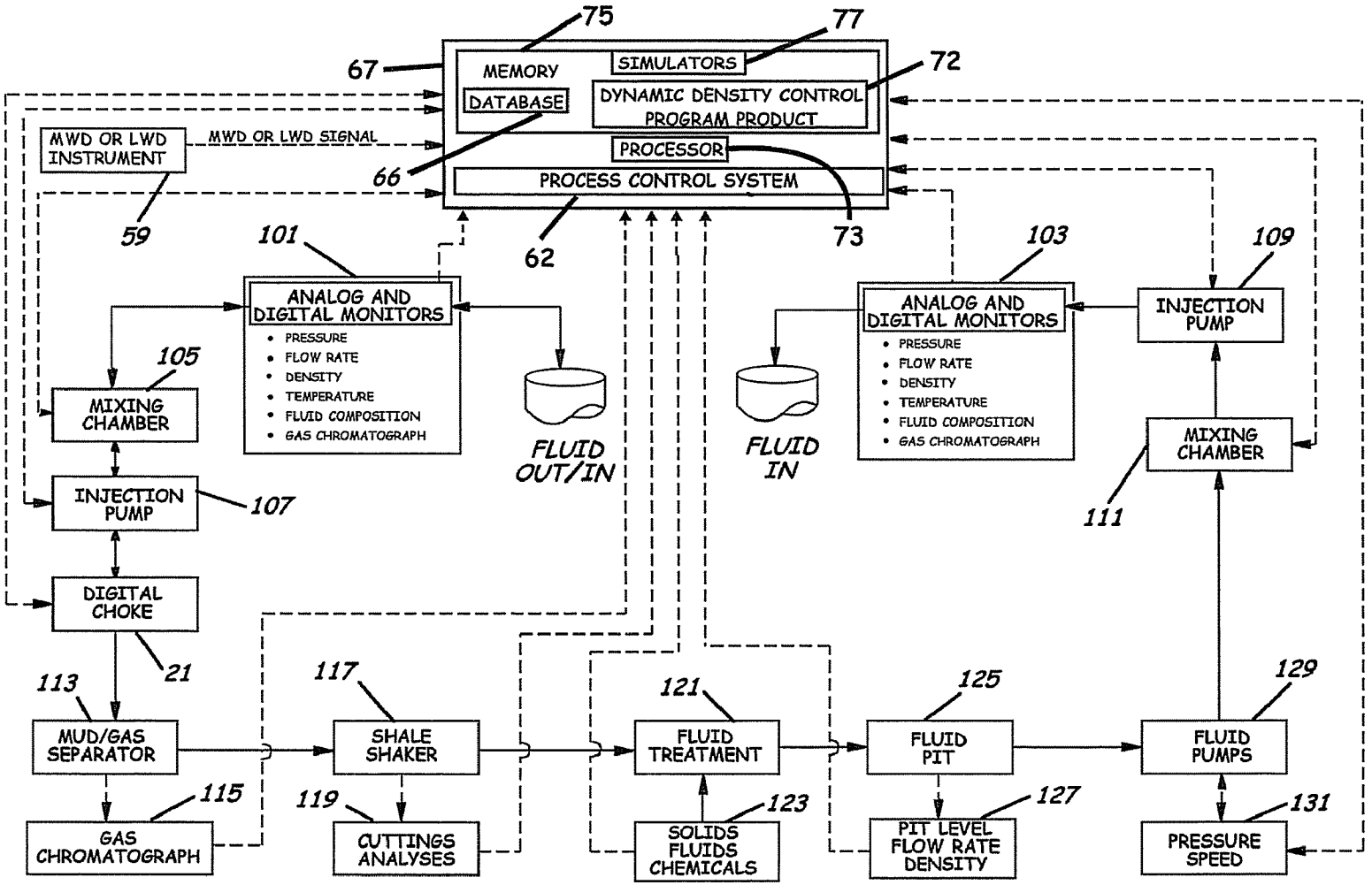
FIG. 3 is a schematic diagram illustrating mass and energy transfer and data communication according to an embodiment of the present invention.
Figure 4:
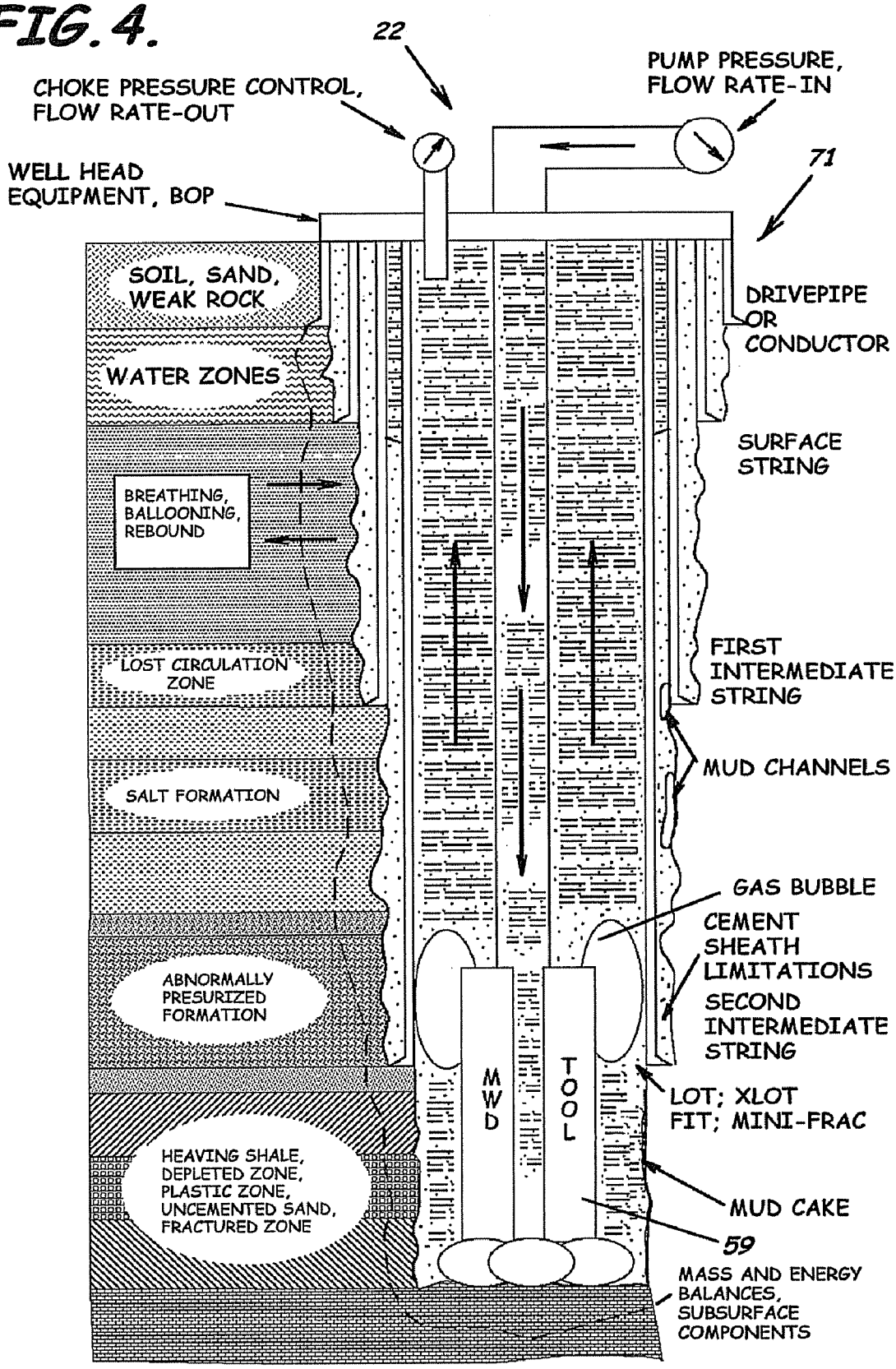
FIG. 4 is a schematic diagram of drilling equipment and earth formations according to an embodiment of the present invention.

The equipment of this embodiment of the invention also includes a test pump 61 or fluid pumps 129 mounted on platform 11 (see, e.g., FIGS. 2A, 2B and 3). The test pump 61 (FIG. 2B) is an accurate low volume pump, preferably of positive displacement. The test pump 61, for example, need be capable of pumping only a few gallons per minute. A flow meter 63 accurately measures the amount of drilling fluid pumped by the test pump 61. Also, a pressure gauge 65 (see also pressure speed 131) accurately records the pressure of the drilling fluid being pumped by the test pump 61. The outlet of the test pump 61 leads to the interior of the drilling pipe 17, for example, at an elevation above the surface pressure control equipment 19. The test pump 61 has an intake connected with a fluid pit 33.

The computer 67 is located, e.g., at rig 11, for controlling the choke 21, the fluid pumps 129 via pressure and speed controller 131, fluid composition via the mixing chambers 105, 111, and injection pumps 107, 109. The computer 67 includes a processor 73 and memory 75 coupled to the processor 73. The memory 75 can include volatile and nonvolatile memory known to those skilled in the art including, for example, RAM, ROM, and magnetic or optical disks, just to name a few. The computer 67 includes in memory 75 or has access to one or more databases 66. The database 66 or databases 66 can include one or more individual modules. The computer 67 also includes inputs as known by those skilled in the art for receiving data from the various parameters and a process control system 62 utilized in real-time. Dynamic density control program product 72 is stored in the memory 73 of the computer 67 to perform the various functions described below. The dynamic density control program product 72 can form part of the process control system 62 or can function as a stand-alone unit capable of communicating with the process control system 62. The process control system 62 as known and understood by those skilled in the art can be implemented in hardware, software/program product, or a combination thereof.

Figure 7:
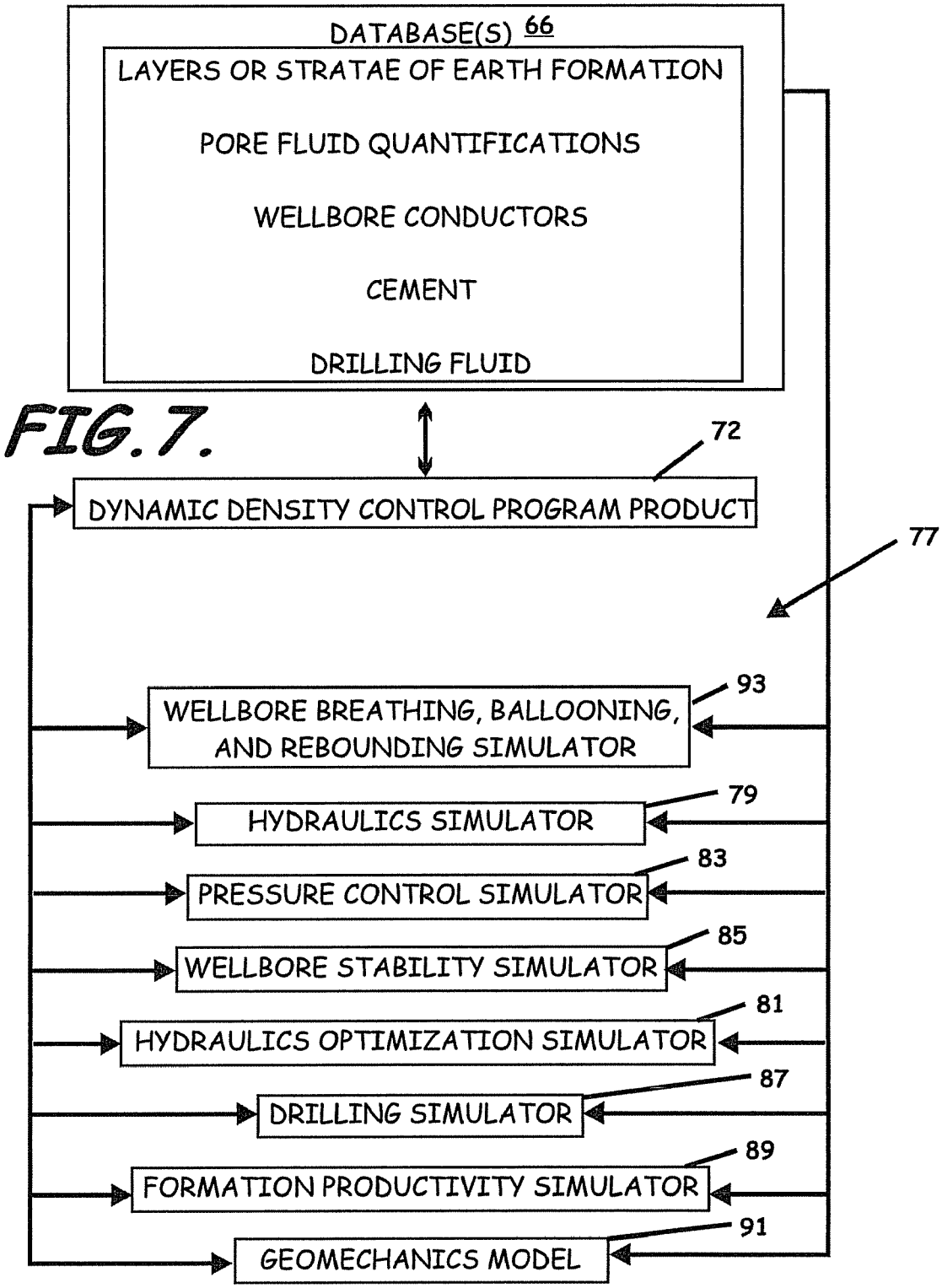
FIG. 7 is a schematic block diagram of functional software/program products modules according to an embodiment of the present invention.

As shown in FIG. 7, the computer databases 66 can include parameters relating to each layer or stratae of earth formation, the pore fluid quantifications within each layer or stratae of earth formation, each string of casing, each layer of cement, as well as the fluid or mud within the drilling pipe 17 and the annulus 18, which can also be included in the computer 67. The databases 66 of the computer 67 (or a separate database) also can include information concerning the compressibility of the various earth formations, including subsurface stratae and the pore fluids residing within the stratae through which the well will extend and the compressibility of the drilling fluid. The computer databases 66 can include additional parameters such as, for example, pressure, flow rate, density, temperature, fluid composition, and gas chromatograph information in a real-time basis, both at the inlet side of the drill pipe 17 and the outlet end of the annulus 18. The computer databases 66 also can include a myriad of other parameters, as understood by those skilled in the art, such as, for example, information from the pressure gauge 69 or the mud pulse decoder 60.

As also shown in FIG. 7, embodiments of systems, program products, or methods of the present invention can also include other software modules or programs that function as simulators 77 that interact or communicate directly with one or more computers 67 in a real-time basis. A hydraulics simulator 79, for example, can calculate the frictional pressure drop throughout the system 22. A hydraulics optimization simulator 81 can optimize hydraulic energy at the drill bit. A pressure control simulator 83 can control kicks that may occur within the system. A wellbore stability simulator 85 can determine fracture pressures and collapse pressures of the earth formation. A drilling simulator 87 can determine rate of penetration parameters. A formation productivity simulator 89 can assess the production impairment due to drilling fluid invasion. A geomechanics model 91 can provide information relating to the way earth formations react with the system under varying conditions of pressure, temperature, density, and flow rate. A wellbore breathing, ballooning, and rebounding simulator 93 can account for the expansion and contraction of the wellbore and surrounding volumes under dynamic conditions.

The various components and sensors controlled or monitored by computer 67 can be separately switched on or off according to various combinations, as desired. Further, the various functions of the dynamic density control program product 72, systems, and the various simulators 77 can be run in parallel for back up, redundancy, to obtain more data points, and/or for comparison for checking with each other, to validate data, to allow one to do some and another others, and/or for calibration based on known guidelines. The surface monitors or sensors 101, 103 and bottom hole sensor 59 can each be one or more sensors, preferably a plurality at each sensing location, e.g., input, output, and in well, that can function separately or in unison. Further, the control functions can be shut down in order to function as a conventional system or can be emergency situations so that the original system used by a rig can then be used or reverted back to (or be manually operated) as a back up or precautionary measure.

As shown in FIGS. 1-11, and embodiment of the system, program product, and methods can provide operators the ability to determine separately for each of the plurality of laterally separated locations of interest at least one drilling fluid control variable system limitation of a drilling fluid control variable, measure a value of an operationally induced drilling fluid parameter at each of a plurality of separate locations when drilling, predict separately for each of the plurality of laterally separated locations of interest a value of the drilling fluid control variable in response to each measured drilling fluid parameter value, and control at least one drilling fluid parameter in response to each predicted control variable value and each associated at least one drilling fluid control variable system limitation. The locations of interest can include a specific weak point in at least one of the plurality of casing strings, a specific weak point in, e.g., at least one cement layer surrounding one of the plurality of casing strings, a portion of an earth formation located, for example, at the bottom of the wellbore, and/or a regions or areas which can change dynamically, can be strategic, and can vary in size and dimension. Ascertaining the general location and effect of such locations of interest are described in more detail, later.

Figure 8:
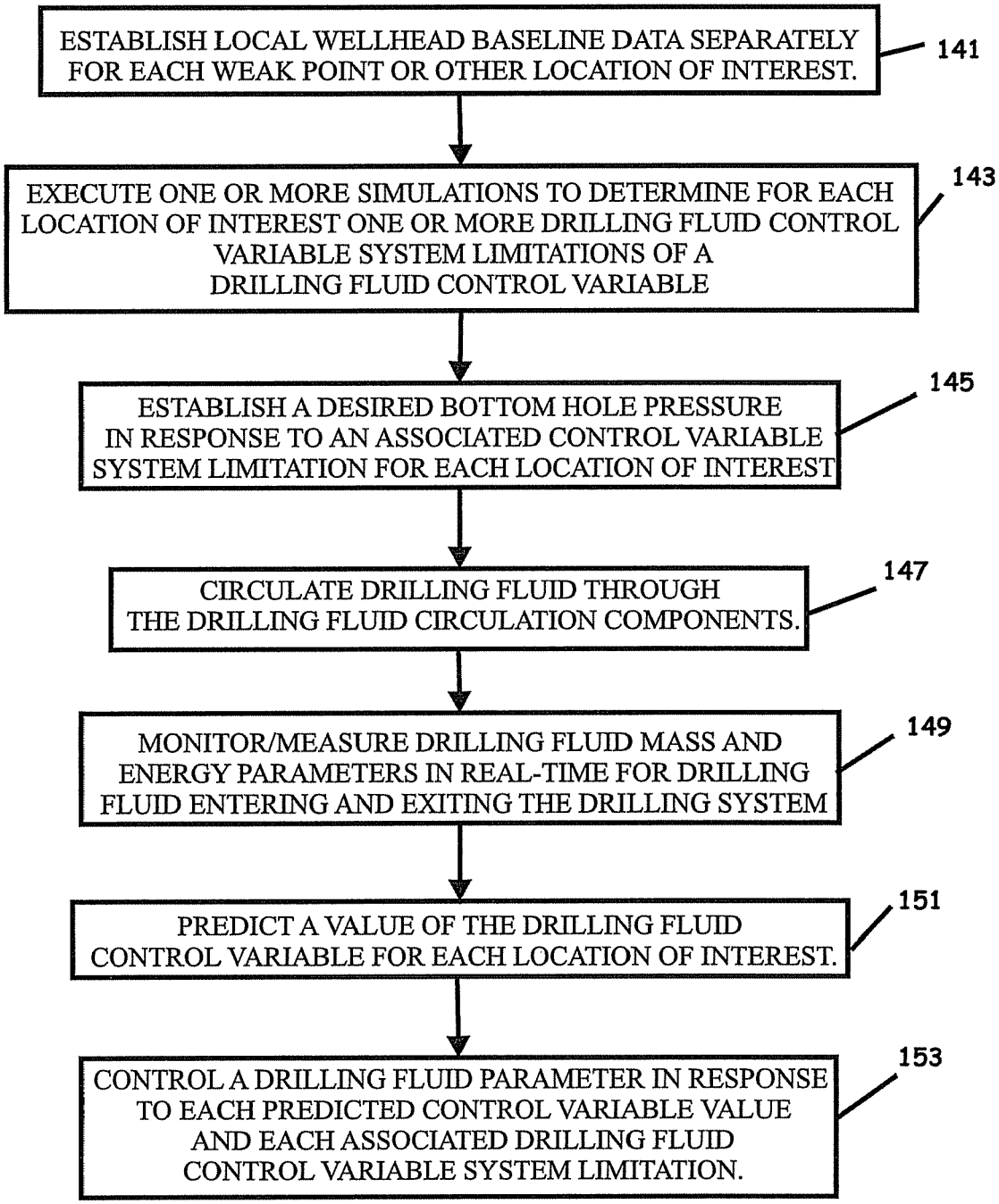
FIG. 8 is a schematic flow diagram illustrating a method of controlling drilling fluid parameters according to an embodiment of the present invention.

More specifically, as perhaps best shown in FIG. 8, according to embodiment of the present invention, through performing various tests and/or simulations, the computer 67 can establish local wellhead baseline data separately for each weak point or other locations of interest (block 141). The computer 67 either directly from the baseline data or through execution of one or more simulations can determine for each location of interest one or more drilling fluid control variable system limitations of a drilling fluid control variable (block 143). By knowing the limitations of each weak point or other location of interest, the operator can establish a desired bottom hole pressure and a combination of drilling fluid parameters, e.g., pressure, flow rate, density, temperature, and composition, that will maintain the drilling fluid within the limitations of each weak point or other location of interest and maintain the desired bottom hole pressure (block 145). During drilling operations, the operator will circulate drilling fluid through the drilling fluid circulation components, e.g., pump 129, drilling string 17 inlet and inlet associated components, drilling string 17, bottom hole wellbore adjacent the drill bit, annulus 18, riser 13 outlet, and outlet associated components (block 147). During circulation and during drilling, the computer 67 can monitor/measure drilling fluid mass and energy parameters in real-time for drilling fluid entering and exiting the drilling circulation system/components (block 149). Through use of the baseline data, simulations, and current drilling fluid parameters, the computer can predict a value of the drilling fluid control variable for each location of interest (block 151), and can control a drilling fluid parameter in response to each predicted control variable value and each associated drilling fluid control variable system limitation (block 153).

Figure 9:
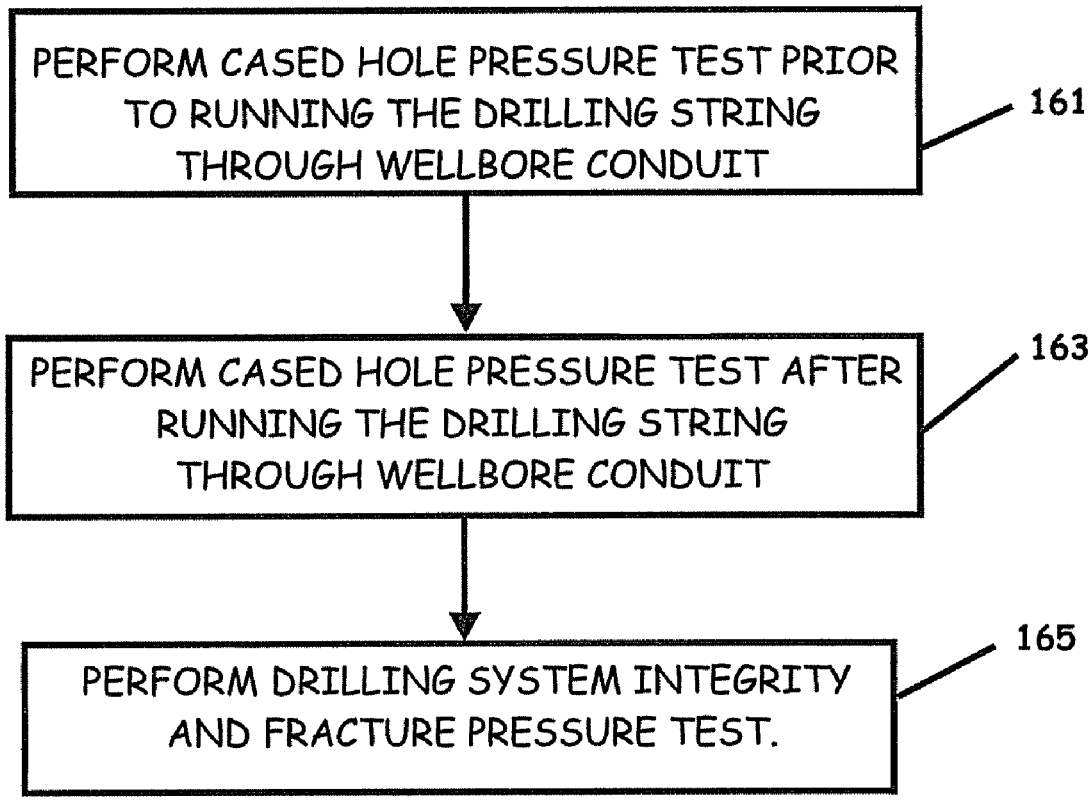
FIG. 9 is a schematic flow diagram illustrating a method of establishing baseline data for controlling drilling fluid parameters according to an embodiment of the present invention.
Figure 10:
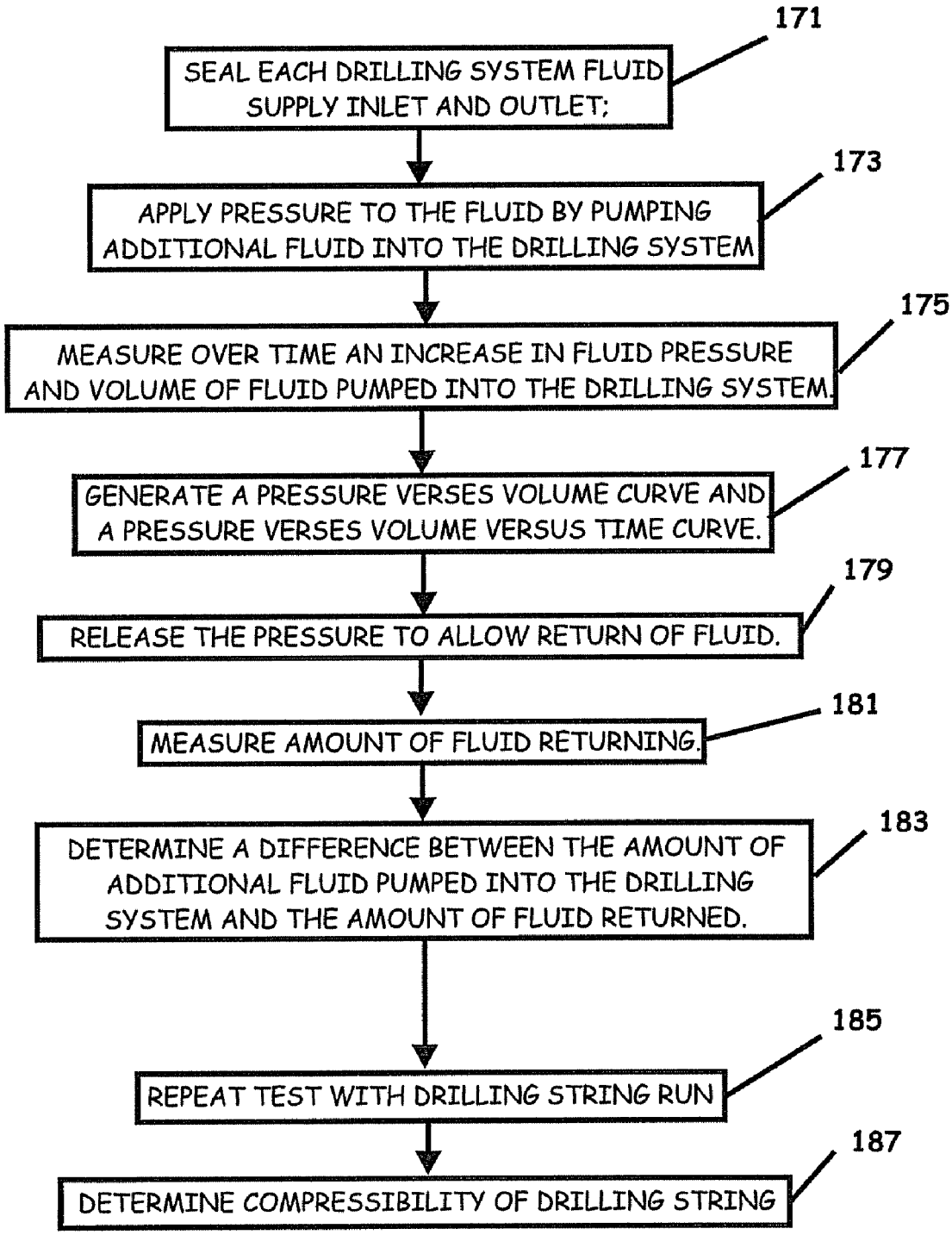
FIG. 10 is a schematic flow diagram illustrating a method of iteratively performing a cased hole pressure test according to an embodiment of the present invention.

As shown in FIG. 9, the baseline data can be established through performance of a cased hole pressure test prior to running the drilling string 17 through wellbore conduit (block 161), performing a cased hole pressure test after running the drilling string 17 through wellbore conduit (block 163), and performing a drilling system integrity and fracture pressure test (block 165). These tests are described below. Alternatively, the baseline data can be prestored in databases 66 or determined real-time during actual drilling operations.

As perhaps best shown in FIGS. 6A, 6C, 6E, and 10, in the embodiment of a system and method of this invention, after conductor pipe 41 or casing 47, 51 has been installed and cemented in place, the operator runs a cased hole pressure test. The first cased hole pressure test can occur before drilling out below the lower end of conductor pipe 41. The operator performs the first part of cased hole pressure test before running the drill string 17 into the riser 13. The riser 13 is filled with liquid, such as drilling fluid. The operator closes the riser 13 with the surface pressure control equipment 19 and the choke 21 or valves (not shown) between the choke 21 and the riser 13 (block 171). The operator then begins applying pressure to the drilling fluid by pumping more drilling fluid into the riser 13 with the test pump 61 (block 173). During the test, the operator measures the increase in pressure over time with the pressure gauge 65 (block 175). The test pump 61 pumps drilling fluid into the riser 13 while measuring the amount being pumped with the flow meter 63 as well as the pressure with the pressure gauge 65. For example, the operator can apply pressure to a selected maximum that is a safe level below the yield strength of the riser 13 and the conductor pipe 41. This pressure causes compression of the drilling fluid, radial expansion of the riser 13, the conductor pipe 41 and the cement layer 43. The expansion of the cement layer 43 compresses the surrounding earth formation. Data are generated during this test that are transmitted to the computer 67.

As understood by those skilled in the art, the computer 67 generates a pressure versus volume curve ("PV"). The pressure is the fluid pressure sensed by the pressure gauge 65, and the volume is the amount of drilling fluid pumped by the test pump 61 during the test. The PV curve is not linear and indicates that, eventually, increased pressure will result in very little increased volume of drilling fluid entering the riser 13. The computer 67 also generates a pressure over volume versus time ("PVT") curve (block 177). The time is the amount of time occurring during the test. The operator then releases the pressure and turns off the test pump 61 (block 179). The flow meter 63 can measure the return flow of drilling fluid flowing back into the fluid pit 33 (block 181). The amount returning should be substantially the same as the amount that was pumped in by the test pump 61. Any difference resulting from the measurement, for whatever reason, will be duly recorded and analyzed (block 183).

The data generated by this test simulates "breathing" and "ballooning" that occurs during drilling operations. Ballooning occurs as a result of expansion of riser 13, expansion of conductor pipe 41, expansion of any strings of casing 47, 51, expansion of the cement, and/or expansion of the rock or earth formation, due to drilling fluid pressures being exerted. The drilling fluid pressure includes the static pressure resulting from the weight of the drilling fluid as well as the flowing or dynamic pressure caused by the operation of fluid pumps 109 and the frictional effects within the conduits, during drilling operations. Breathing occurs as a result of contraction of the riser 13, contraction of the conductor pipe 41, contraction of any strings of the casing 47, 51, contraction of the cement, and/or contraction of the rock or earth formation, due to a decrease in fluid pressure. Breathing occurs as a result of the pressure dropping, such as cessation of or reducing the flow rate fluid pumps 129. Stopping the fluid pumps 129 removes the dynamic pressure component, resulting in a lower pressure being exerted on the conductor 41 and the surrounding earth formation. Lower pressure results in a contraction of the conductor 41 and a return of some of the volume of drilling fluid that occupied the space during the ballooning expansion.

After the test has been made as described above, the operator lowers the drill string 17 into the riser 13. Normally the lower end of the drill string 17 is open, causing it to fill with drilling fluid as it is lowered into the well. The operator performs the same cased hole pressure test with test pump 61 while drill string 17 is located within riser 13 (block 185). That test will allow the computer 67 to account for the compressibility of drill pipe 17 as a result of drilling fluid pressure exerted on the interior and exterior of drill pipe 17 (block 187).

Figure 6A:
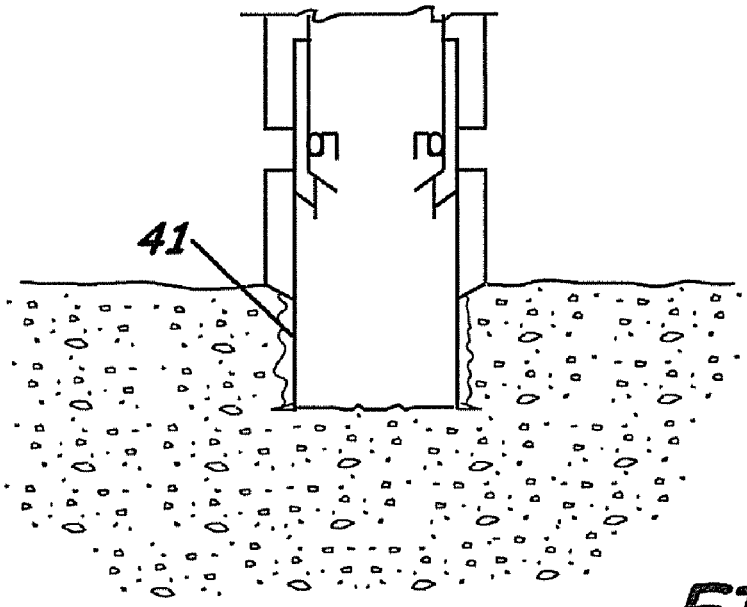
FIG. 6A-6F are schematic diagrams illustrating progression of a wellbore during testing according to an embodiment of the present invention.
Figure 6B:
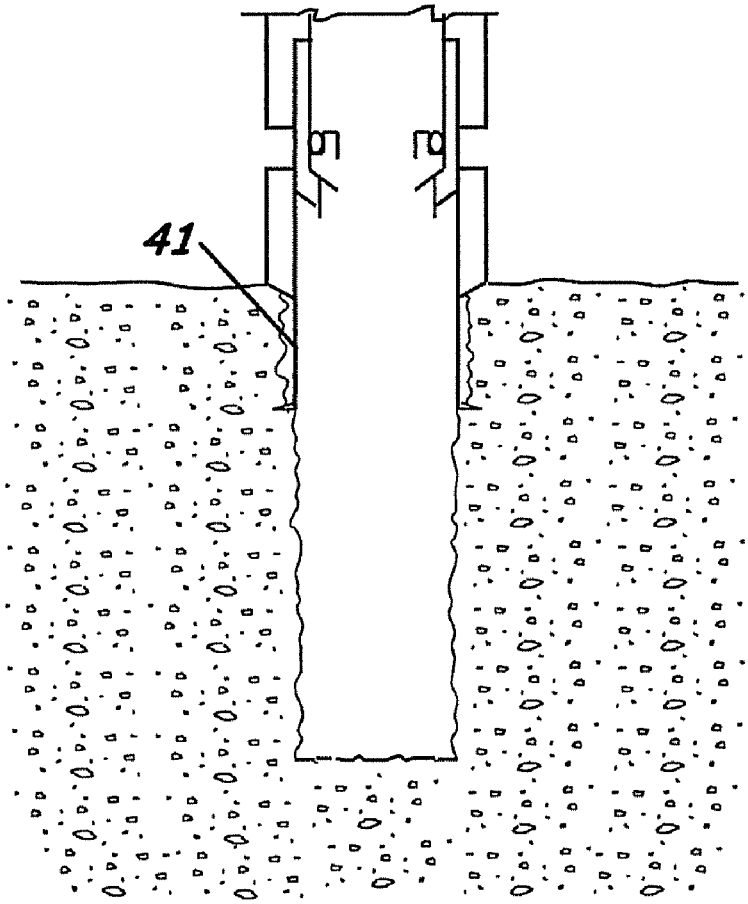
Figure 6C:
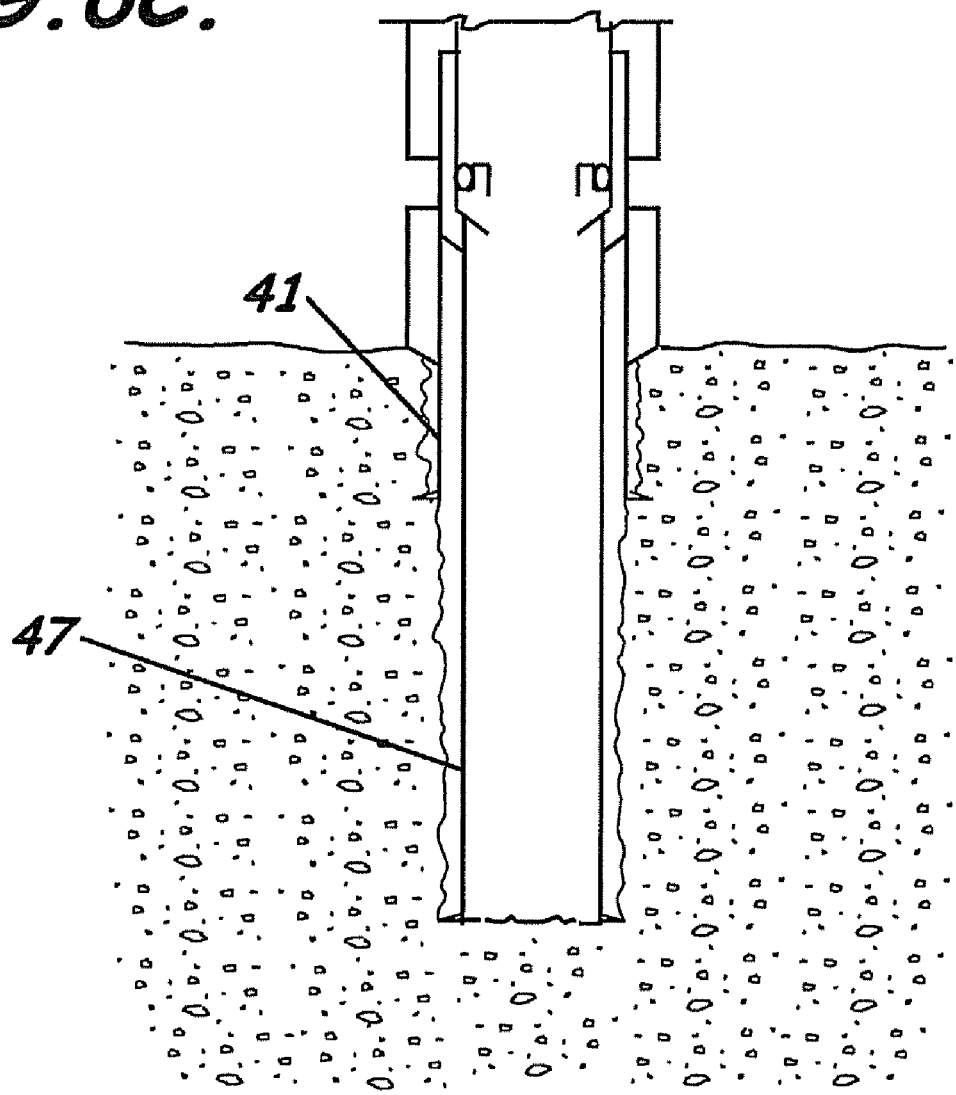
Figure 6D:
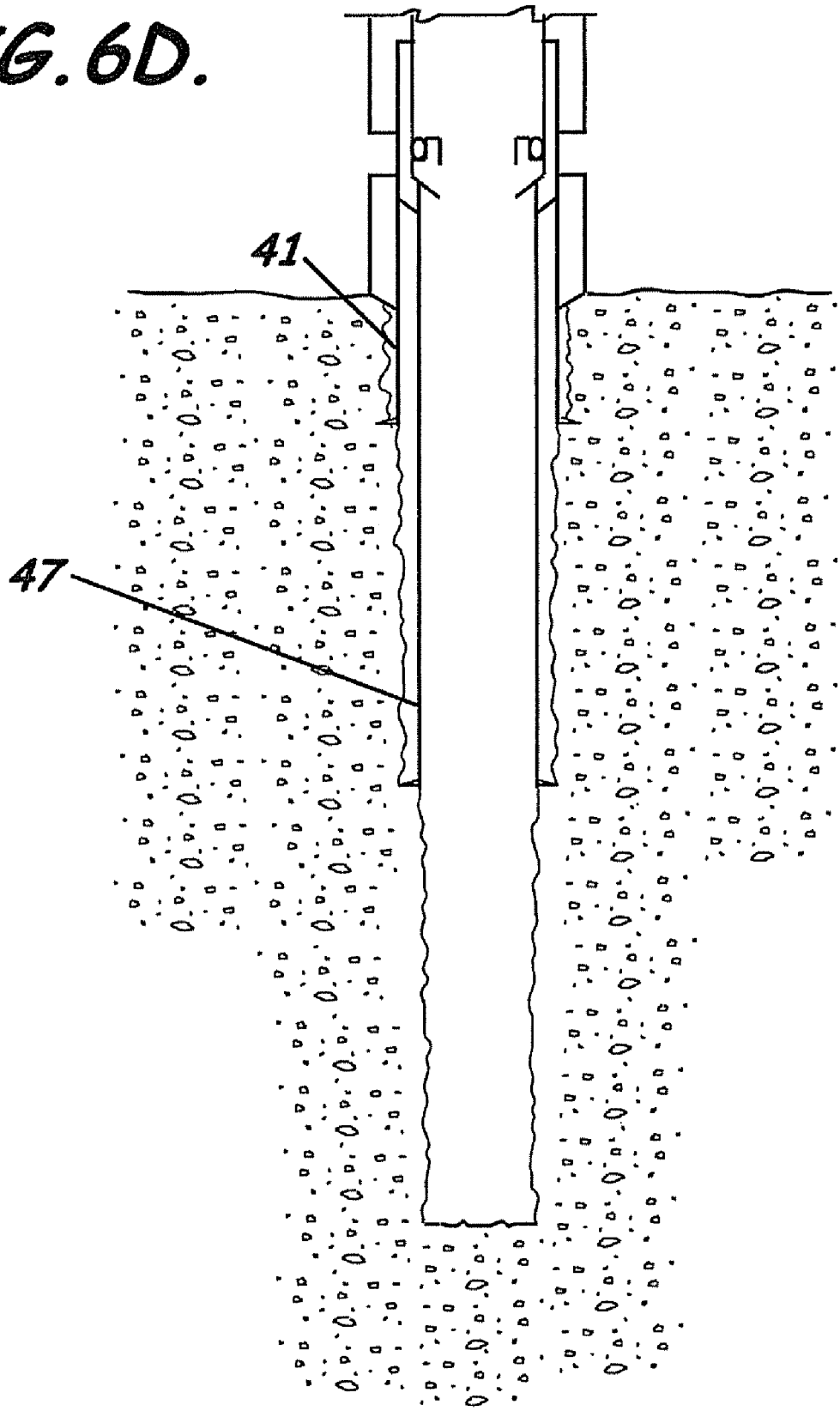
Figure 6E:
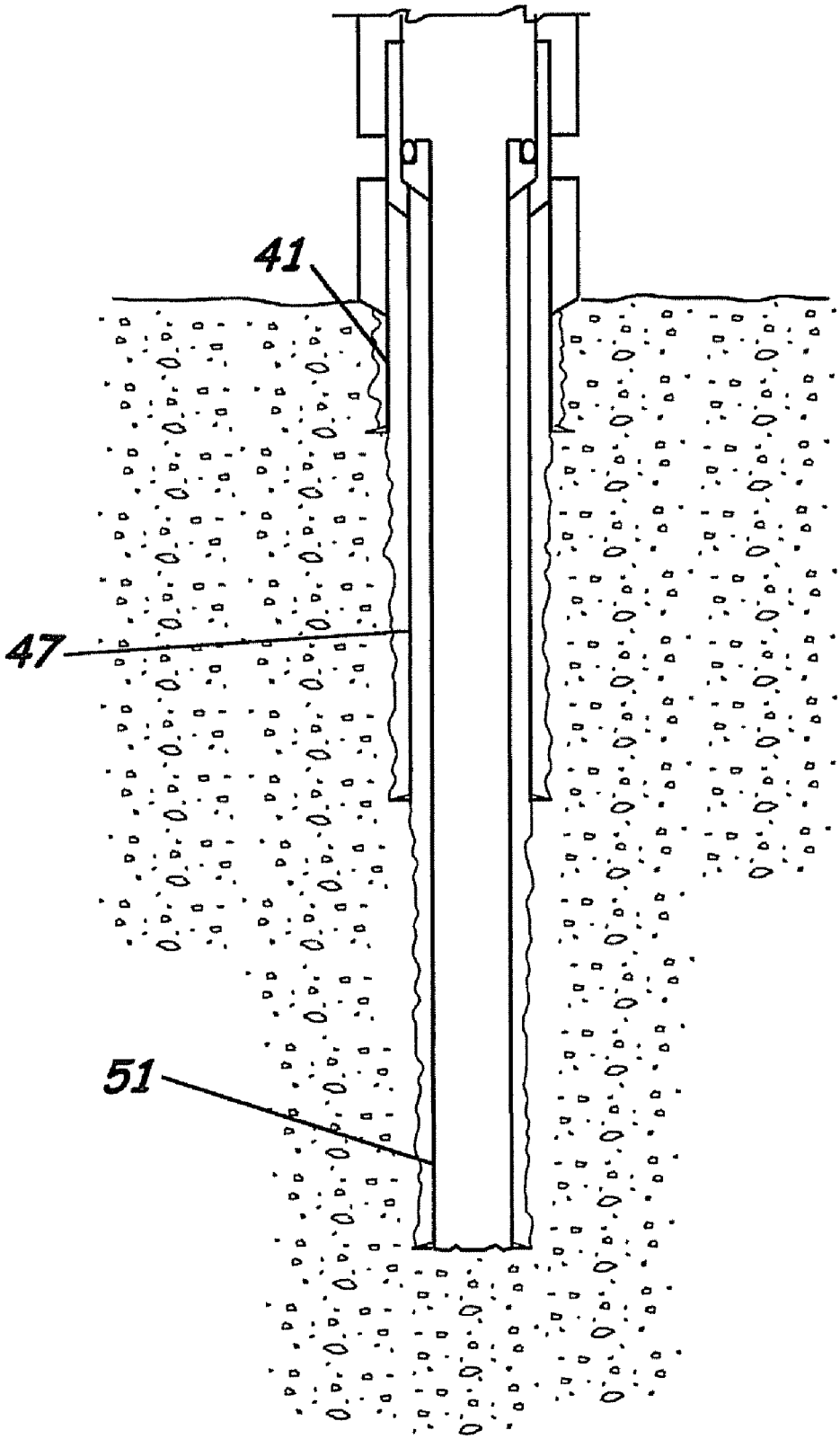
Figure 6F:
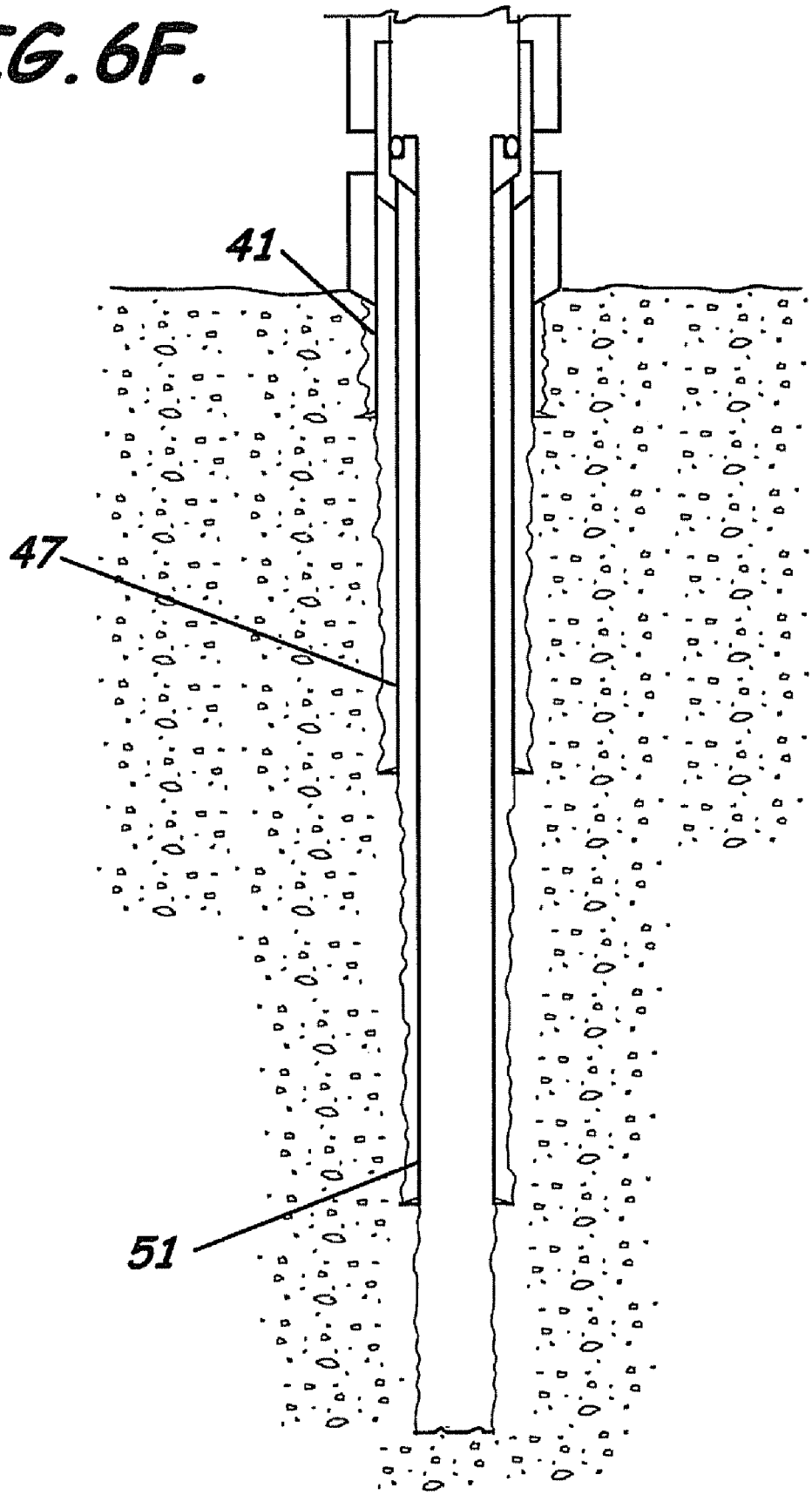
Figure 11:
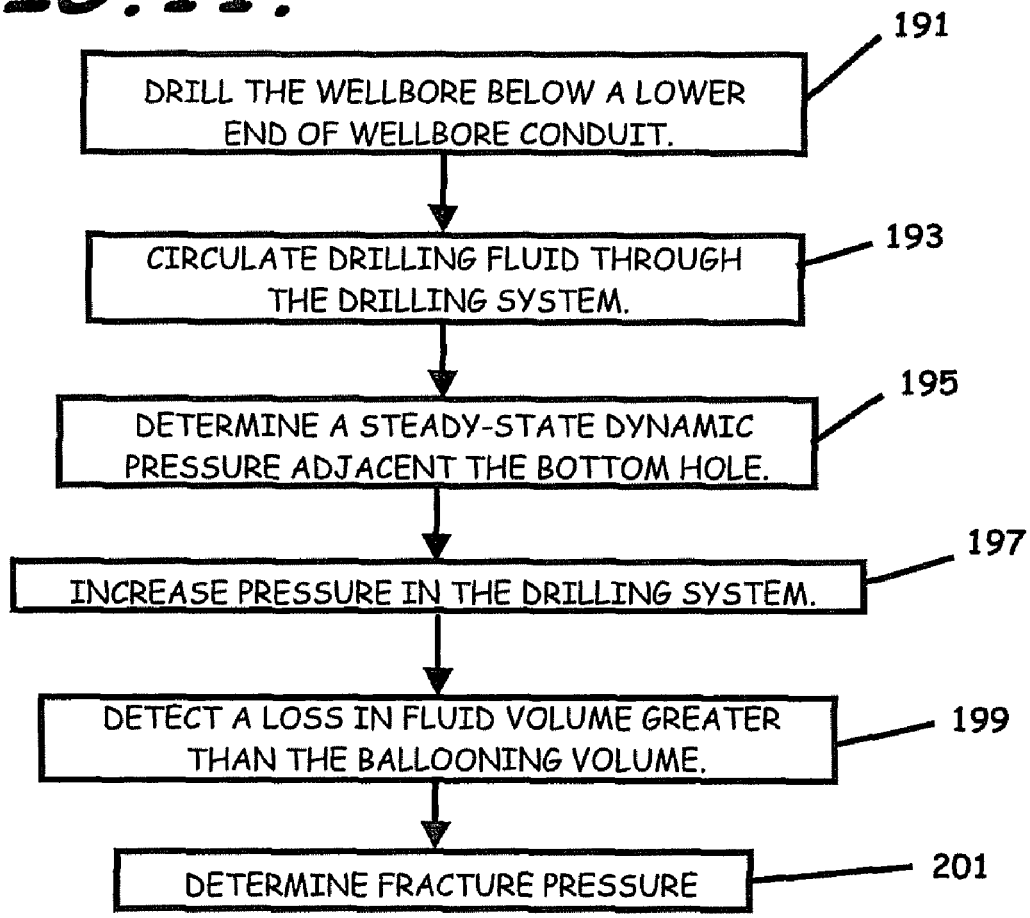
FIG. 11 is a schematic flow diagram illustrating a method of performing an integrity and fracture test according to an embodiment of the present invention.

As perhaps best shown in FIGS. 6B and 11, the operator then drills down a few feet below the lower end of the conductor pipe 41 (block 191) and circulates drilling fluid with the fluid pumps 109 (block 193). The operator makes another test a short distance below the conductor pipe 41 in the open hole to determine the integrity of the sealing of cement 43 between the earth formation and the conductor pipe 41. In this test, the operator will seek to learn the maximum pressure that can exist at the lower end of the conductor pipe 41 without fracturing the earth formation or the bonding of the cement 43. In one method of performing this test, the operator will begin operating the fluid pumps 129 and circulating the drilling fluid through the choke 21 back to the fluid pit 125 (block 193). Downhole pressure MWD instrument 59 senses the dynamic pressure adjacent the lower end of the conductor pipe 41 and transmits data to the fluid pulse decoder 60 and the computer 67 (block 195). The operator gradually closes the choke 21 or increases the output pressure of pump 129 (block 197), which increases the pressure within the interior of the drill pipe 17 and the drill pipe annulus 18. Initially, there will be a drop in the fluid pit level due to ballooning. The volume due to ballooning will be known from the earlier cased hole pressure test conducted with the test pump 61. Any fluid level drop in the fluid pit 33 after the ballooning volume increase will be due to encroachment into the formation or at the bond lines of the cement layer(s) 43. Eventually, the fracture pressure of the formation is reached, and some drilling fluid will begin encroaching into the earth formation adjacent the lower end of the conductor pipe 41 or through the cement layer 43. This loss in drilling fluid will be detected by the level sensor 34 and the flow meter 63 (block 199). The point at which this detection occurs is deemed the maximum dynamic pressure that can exist at this point in the well (block 201).

Based on this maximum pressure level at the lower end of the conductor pipe 41, the computer 67 will compute the maximum dynamic bottom hole pressure at future depths to be drilled. For example, if the maximum dynamic pressure at the lower end of the conductor pipe 41 is 1000 psi, the computer 67, knowing the variables, such as, for example, weight and rock compressibility, can compute what dynamic bottom hole pressure if measured at a depth 1000 feet deeper would result in the dynamic pressure of 1000 psi at the lower end of the conductor pipe 41. That bottom hole pressure level might be, for example, 1500 psi. The dynamic bottom hole pressure can be continuously transmitted to the decoder 60 and the computer 67 during drilling by down hole MWD instrument 59, enabling the operator and the computer 67 to make sure that the maximum dynamic bottom hole pressure at each point drilled does not exceed an amount that would result in an excessive bottom hole pressure at the lower end of the conductor pipe 41.

The operator can make the same series of PV and PVT measurements as described above immediately after setting the second string of the casing 47 and the third string of the casing 51. The operator will make the same tests in the open hole immediately below the lower end of each string of the casings 47, 51 to determine the maximum bottom hole pressure allowable at the lower end of each casing string as each casing string is added.

The operator then continues drilling, using a desired fluid weight, pump pressure, and choke adjustment to maintain the desired bottom hole pressure and intermediate component pressures. While drilling, RCH 25 can be sealing around the drill pipe 17, the pump 129 can be applying a controlled positive pressure, and the choke 21 can be applying a controlled back pressure. Further, other parameters such as, for example, temperature, or gas composition of the drilling fluid when using multiphase drilling fluid, can be adjusted to control dynamic pressure. The surface pressure in the riser 13 can be measured by the pressure gauge 69 and sent to the computer 67. Normally, the operator will know from calculations and prior information the pore pressure of the various earth formations to be drilled. In overbalanced drilling the weight of the drilling fluid and the setting of the choke 21 is selected so that the dynamic pressure at the lower end of the conductor pipe 41 (or the casing strings 47, 51) is greater than the pore pressure, but less than the fracture or leak off pressure. In near balanced drilling the dynamic pressure is approximately the same, and in under balanced drilling, the dynamic pressure is less than the pore pressure. All three types of drilling may be performed with embodiments of systems and methods of the present invention.

Embodiments of the system, program product, and methods of the present invention provides a real-time solution to maintain the bottom hole pressure between the pore pressure and the maximum fracture pressure or lost circulation pressure by continually comparing the bottom hole pressure to the pore pressure and the maximum fracture or lost circulation pressures. Pressure of the drilling fluid can be controlled by adjusting the weight of the drilling fluid. The weight of the drilling fluid may be adjusted by regular conventional procedures. For example, the weight may be increased by adding more solids and fluid chemicals and lightened by introducing liquids or gases such as nitrogen into the drilling fluid at the platform. The bottom hole pressure may be increased by gradually adding more weight to the drilling fluid, adjusting the orifice of the choke 21 to increase the backpressure, or increasing pump pressure of the pump 129, or a combination thereof. The bottom hole pressure may be decreased by adding lower density material, e.g., nitrogen, to the drilling fluid, adjusting the orifice of the choke 21 to decrease back pressure, decreasing pump pressure of the pump 129, or a combination thereof. Further, according to an embodiment of the system, backpressure can be increased during both drilling operations and when not drilling by adding/injecting drilling fluid into the annulus 18 and correspondingly decreased by removing drilling fluid from the annulus 18. Still further, bottom hole pressure may be modified by adjusting the drilling fluid temperature as known and understood by those skilled in the art.

Drilling fluid measurements can be made. For example, the drilling fluid can be circulated through the system in a systematic manner utilizing the method of the present invention illustrated in FIG. 3. As the fluid returns through the outlet side of the annulus 18, the fluid is flowed through a series of analog or digital monitors 101 that can measure pressure, flow rate, density, temperature, fluid composition, gas chromatograph information, and other useful information. The analog or digital monitor 101 is in data communication with the computer 67 and the database 66. The fluid then flows through a mixing chamber 105 where other fluids or other substances may be added thereto, and then through an injection pump 107, and then through an analog or digital choke 21, each of which are in data communication with the computer 67 and the database 66.

Then the fluid can flow through a mud/gas separator 113, which produces a gas chromatograph in data communication with the computer 67 and the database. Then the fluid can flow through the shale shaker 117, which produces a cuttings analysis 119 in data communication with the computer 67 and the database 66.

Then the fluid can flow through the fluid treatment chamber 121 where other solids, fluids, chemicals, or other substances can be added thereto, and which is in data communication with the computer 67 and the databases 66. Then the fluid can flow through the fluid pit 125, which evaluates and monitors pit level or fluid level, flow rate, pressure, density, or other parameters 127 which are in data communication with the computer 67 and the database 66.

Then the fluid can flow though the fluid pump chamber of fluid pump 65, 129, which regulates the pressure speed control 131 by being in data communication with the computer 67 and databases 66. Then the fluid can flow through another mixing chamber 111 where fluids or other substances may be added thereto, and then through another injection pump 109, each of which are in data communication with the computer 67 and database 66. As the fluid circulates through the system, the fluid is flowed through another series of analog or digital monitors 103 that can measure pressure, flow rate, density, temperature, fluid composition, gas chromatograph information, and other useful information. The analog or digital monitor 103 is in data communication with the computer 67 and the database 66. Finally, then the fluid can flow into the inlet side of the drill pipe 17 for circulation through the drill pipe 17 and into the annulus 18.

While drilling, if the pit level sensor 127 indicates a drop in the volume of fluid, this information will be supplied to the computer 67 to determine whether or not lost circulation exists. A drop in drilling fluid volume may be indicative of well bore expansion due to ballooning, which happens when the fluid pumps 109 are initially turned on or the back pressure in annulus 18 increased. Alternately, a loss in fluid pit level while drilling could indicate that lost circulation is occurring wherein drilling fluid flows into one of the earth formations in an excessive amount. The computer 67 makes an analysis of the loss in fluid volume based upon the PV and PVT curves and the data stored concerning the compressibility of the earth formations, including subsurface stratae and the pore fluids residing within the stratae and the compressibility of the drilling fluid. The computer 67 can inform the operator of the reason for the change in fluid volume, enabling the operator to take remedial action if necessary.

The fluid or mud head pressure within the annulus 18, just outside the drill bit 57, is Known as the equivalent circulating density (ECD) or the circulating bottom hole pressure. The fluid or mud head pressure or circulating bottom hole pressure is substantially equal to the sum of the static pressure, and the pressure due to annular friction losses in the annulus 18. The circulating bottom hole pressure, in an embodiment, can be maintained at a pressure greater than the pore pressure resulting from the particular layer or strata of earth formation, and maintained at a pressure less than the maximum fracture pressure gradient of the casing and cement structures. Correspondingly, embodiments of a system and a method of the present invention provides a real-time solution to maintain the bottom hole pressure between the pore pressure and the maximum fracture pressure (or lost circulation pressure) by continually comparing the bottom hole pressure to the pore pressure and the maximum fracture or lost circulation pressures.

Embodiments of the system and methods can also control fluid kicking. Fluid kicking, as understood by those skilled in the art, occurs when the pore pressure from one of the stratas of earth formation is greater than the fluid or mud head pressure. In the event of a fluid kick, the bottom hole pressure sensed by the MWD instrument 59 normally will initially increase. Also, a kick would normally result in some increase in the level of drilling fluid in the fluid pit 33 as sensed by sensor 34. The increase in bottom hole pressure and increase in the fluid pit 33 level could also be due to a breathing in of the earth formation and various strings of casing and cement. The computer 67 refers to the PV and PVT curves to determine whether or not the increase in bottom hole pressure or increase in the pit 33 level is due to breathing or due to a fluid kick. If due to a breathing in, the computer 67 may adjust the choke 21 for a short while to reduce the bottom hole pressure. If the computer 67 determines that a fluid kick is occurring, drilling may continue while the fluid kick is circulated out. As the gas expands, choke pressure is changed such that bottom hole pressure remains constant as determined by the MWD measurement, and fracture pressure at the casing seat uphole is not breached.

Operators ordinarily will not be certain whether a source of back pressure is due to kicking or merely due to breathing after previous ballooning. In any event, to overcome or kill the kicking, the system or method can circulate more mud through the drill pipe 17 to increase the mud weight to respond to the apparent kicking. This acts to force the kicking fluid out from the annulus 18 while increasing the weight and density of the fluid or mud circulating through the drill pipe 17 and the annulus 18, and restore the circulating bottom hole pressure as being greater than the pore pressure from the earth formation. If the circulating bottom hole pressure becomes greater than the maximum fracture pressure gradient, it can cause a fracture of the casing and cement structures and a subsequent loss of circulation. Therefore, embodiments of the system or method can increase the weight and density of the fluid or mud cautiously and/or can simultaneously add choke pressure to prevent kicking and can decrease the weight and density of the fluid or by cautiously and/or simultaneously reduce choke pressure so as to prevent the bottom hole pressure from exceeding the maximum fracture pressure. Embodiment of the present invention can also increase input pump pressure and/or inject fluid into the annulus 18, or a combination thereof.

The PV curve and the PVT curve along with the data concerning the formations enable the operator to more accurately control the bottom hole pressure and thus the dynamic pressure at the lower ends of the casing strings 47, 51. This information takes into account the compressibility of the drilling fluid both in the drill pipe 17 and in the annulus 18. The computer 67 also takes into account expansion and contraction of the riser 13, casing 41, casing strings 47, 51, and the drill pipe 17 as well as the earth formations, including subsurface stratae and the pore fluids residing within the stratae surrounding the bore hole. This information also allows the computer 67 to determine whether or not a kick, lost circulation, ballooning or breathing is occurring. This embodiment of a system avoids the need to stop drilling to add additional weight to the drilling fluid. With more accurate control, in some cases one or more casing strings may be eliminated.

Embodiments of system and method the present invention can advantageously provide real-time measuring to ensure conservation of matter and conservation of energy in both the well bore and the surrounding subsurface stratae. For example, the material/mass balance into the drill pipe 17 during normal operations should be substantially the same as the material/mass balance out of the annulus 18 as measured by the parameters of the fluid flowing into the drill pipe 17, and the energy balance into the drill pipe 17 should be substantially the same as the energy balance out of the annulus 18 as measured by the parameters of the fluid returning from the annulus 18, taking into account the mass and energy balances in all subsurface components. Any deviations from the material/mass balances or energy balances will be recorded. In addition to providing for conservation of matter and conservation of energy during ordinary drilling operations, the invention can also advantageously provide a real-time method for increasing the fluid or mud head pressure within the drill pipe 17 and annulus 18 in the event of a fluid kick from the subsurface stratae, or even in the event of a sequence of ballooning and breathing that skilled artisans may perceive as a fluid kick from the subsurface stratae.

Embodiments of a dynamic density control system of the present invention is a highly adaptive, real-time, process-control extension of managed pressure drilling with unlimited scalability to any rig, whether large or small, whether on land or on water. Embodiments of the system or method simultaneously quantifies and utilizes combined static and dynamic stresses and displacements at strategic locations within and around both sides of an apparatus, such as a wellbore U-Tube and its several constituent elements, as the well is being drilled. Dynamic pressures at strategic locations in the system are advantageously determined and controlled such that insitu and operationally induced pressure window limitations at specific weak-points are not breached.

Applications for embodiments of systems, program products, and method of the present invention include, for example situations where critical pressure magnitudes and small pressure tolerances, particularly in deepwater operations, have increasingly large economic, technical, safety, and environmental consequences. Productivity impairment during drilling/completion operations is also of great consequence on land or water, and the embodiments may be advantageously utilized on any rig to minimize formation damage during well construction.

Operational wellbore and near-wellbore processes involve several time-varying bulk volumes, stresses, pressures, fluids, and temperatures, coupled and associated with flows, displacement, and movements, some in series and some in parallel fashion. Embodiments of systems, program products, and methods of the present invention can advantageously utilize the coupling of feedback loop control with high-rate, high-quality, time-lapse data logging when circulation is initiated, continued, stopped, or changed, including drill string operations.

Embodiments of systems, program products, and methods of controlling drilling pressures, according to embodiments of the present invention, for example, advantageously provide DDC and DMW. These embodiments having DDC provide highly adaptive, real-time, process control and can be scalable to any rig, large or small, on land or water. Embodiments of systems, program products, and methods also advantageously allow combined static and dynamic stresses and displacements to be determined continuously at strategic locations in and around the wellbore so that insitu and operationally induced pressure window limitations at specific weak-points are controlled. By coupling feedback loops and high-rate, high-quality, time-lapse data logging, for example, embodiments of the present invention allow an operator/service company team to "walk-the-line" or even "move-the-line".

Figure 5:
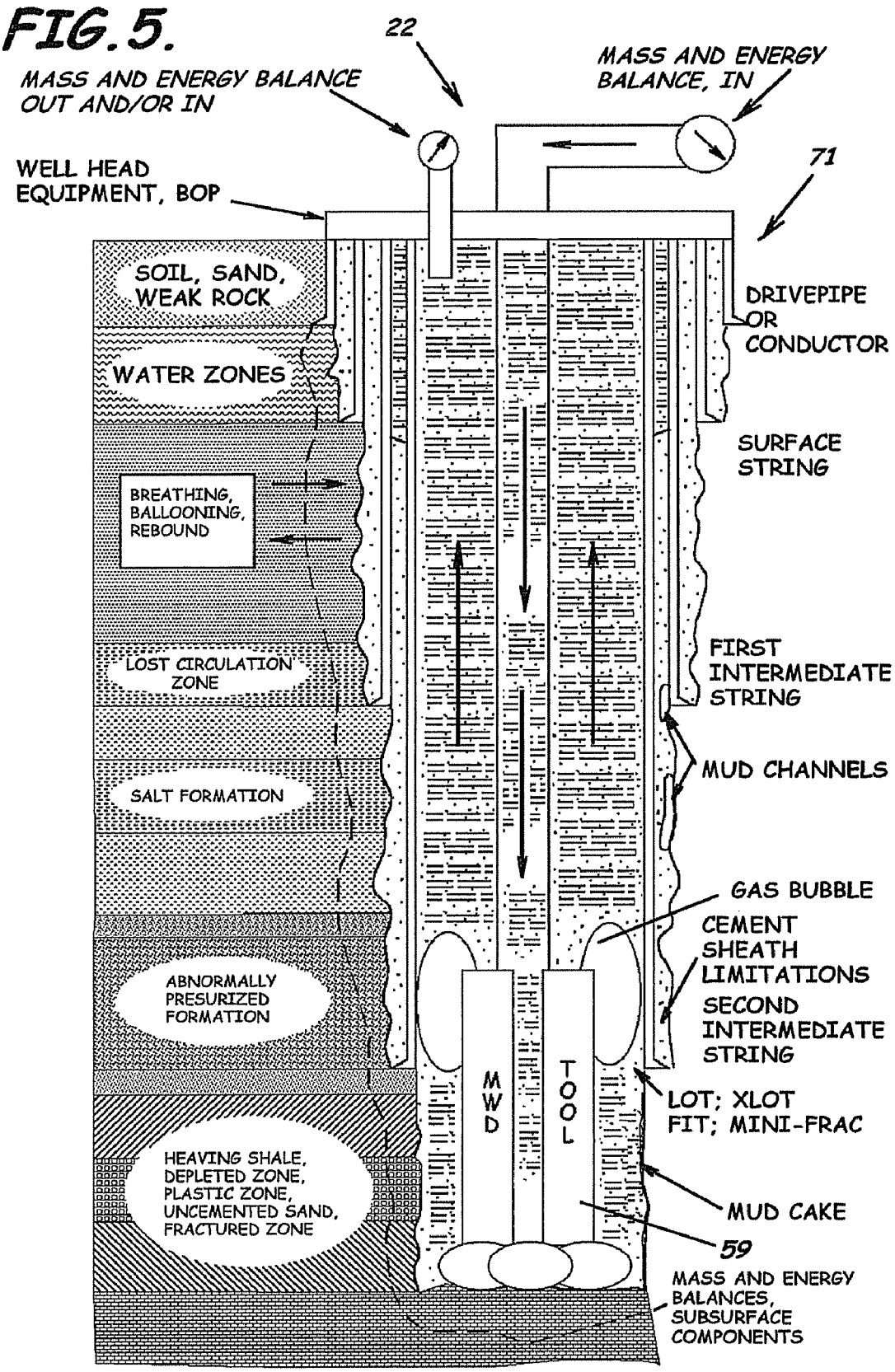
FIG. 5 is a schematic diagram of drilling equipment and earth formations according to an embodiment of the present invention.

For example, as illustrated in FIG. 5, mass and energy balances for an active system account for time-varying bulk volumes, stresses, pressures, fluids, and temperatures, coupled and associated with flows, displacement or movement. On or off switching circuitry can activate individual system element quantifiers in isolation or coupled with other elements. Particularly, all processing functions of computer 67 can be shut off to allow the system 22 to revert to a conventional system.

Additionally, many applications for embodiments of systems, program products, and methods of the present invention abound. For example, applications can include where critical pressure magnitudes and small pressure tolerances have large economic, technical, safety, and environmental consequences; in distinguishing between kicking flow and ballooning flow in kick/loss scenarios; in minimizing formation damage during drilling/completion operations; in identifying likely trouble spots in advance; and in training, predictive, what-ifs, and case studies.

It is important to note that while embodiments of the present invention have been described in the context of a fully functional system, those skilled in the art will appreciate that much of the mechanism of the present invention and/or aspects thereof are capable of being distributed in the form of a computer readable medium of instructions in a variety of forms for execution on a processor, processors, or the like, and that the present invention applies equally regardless of the particular type of signal bearing media used to actually carry out the distribution. Examples of computer readable media include but are not limited to: nonvolatile, hard-coded type media such as read only memories (ROMs), CD-ROMs, and DVD-ROMs, or erasable, electrically programmable read only memories (EEPROMs), recordable type media such as floppy disks, hard disk drives, CD-R/RWs, DVD-RAMs, DVD-R/RWs, DVD+R/RWs, flash drives, and other newer types of memories, and transmission type media such as digital and analog communication links. Such media can include both operating instructions and instructions related to the dynamic density control program product 72 and much of the method steps described above. Such media can also include instructions related to the software/program product portion of the process control system and/or the data contained in databases 66, and/or some or all of the simulators 77.

For example, embodiments of the present invention can include a computer readable medium that is readable by a computer 67 positioned to control drilling fluid parameters, e.g. pressures, in a drilling system 22. The computer readable medium can include a set of instructions that, when executed by the computer, cause the computer to perform the operation of determining separately for each of a plurality of laterally separate locations of interest in a drilling system 22 having at least one casing string 47, 51 or conductor 41 positioned in a wellbore and a drilling string 17 positionable therethrough at least one drilling fluid control variable system limitation of a drilling fluid control variable. The instructions can also include those to perform the operation of measuring a value of an operationally induced drilling fluid parameter at each of a plurality of separate locations when drilling, predicting separately for each of the plurality of laterally separated locations of interest a value of the drilling fluid control variable responsive to each measured drilling fluid parameter value, and controlling a drilling fluid parameter responsive to each predicted control variable value and each associated at least one drilling fluid control variable system limitation.

In the exemplary case where the controlled drilling fluid parameter is dynamic pressure, according to an embodiment of the computer readable medium, the operation of controlling can include modifying fluid pressure of the drilling fluid delivered to a drilling fluid inlet for the drilling system 22 real-time during drilling operations. Further, the operation of controlling can include modifying pressure of the drilling fluid at both the drilling fluid inlet and the drilling fluid outlet during drilling operations. Alternatively, the operation of controlling includes modifying temperature of the drilling fluid delivered to the drilling fluid inlet. When the drilling fluid is a multiphase fluid, the operation of controlling includes modifying inert gas content of the drilling fluid. According to another alternative, the operation of controlling can further includes modifying the density of the drilling fluid by supplying a gas to the primarily liquid drilling fluid to reduce dynamic pressure at at least one of the plurality of locations of interest. Pressure, temperature, density, composition are all parameters that can be controlled individually or in combination, utilizing the drilling system components described previously.

According to an embodiment of the computer readable medium, the operation of determining at least one drilling fluid control variable system limitation for each of the plurality of locations of interest can include performing at least one cased hole pressure test prior to running the drilling string 17 through the casing string 47, 51 to determine an amount of drilling fluid volume input into the drilling system 22 attributable to ballooning during drilling operations, performing at least one cased hole pressure test after running the drilling string to determine an amount of drilling fluid volume input into the drilling system 22 attributable to compression of the drilling string 17 during drilling operations, and performing a drilling system integrity and fracture pressure test to determine integrity of cement 49, 55 sealing the casing string 47, 51, or cement 43 sealing the conductor 41 to the wellbore to thereby determine a maximum pressure that can exist at the lower end of the casing string or conductor without fracturing and associated earth formation or bonding of the cement. These data can be used to describe the physical characteristics of the drilling system to thereby predict the dynamic parameters of the drilling fluid during drilling operations.

As previously shown and described with respect to FIGS. 6A, 6C, 6E, and 10, the operation(s) of performing a cased hole pressure test includes signaling a pump controller of a pressure pump, e.g., test pump 63, to pump additional fluid into the drilling system to thereby compress the drilling fluid, radially expand the casing string and associated cement layer, and compress an earth formation surrounding the wellbore. The test can also include the operations of measuring over time an increase in fluid pressure and volume of fluid pumped into the drilling system 22, generating at least one of the following: a pressure verses volume curve and a pressure verses volume versus time curve, signaling a pump controller of the pressure pump 63 to cease pumping to allow return of fluid not lost to the surrounding formation, measuring an amount of fluid returned; and determining a difference between the amount of additional fluid pumped into the drilling system 22 and the amount of fluid returned, the difference indicating at least one of the following: an amount of potential expansion of components of the drilling system 22 due to a high pressure condition, an amount of potential contraction corresponding with removal of the high-pressure condition. When performed with the drilling string 17 run inside the riser 13, the test can provide an amount of compressibility of the drilling string 17 due to a high-pressure condition. The computer 67 can use pressure gauges 65, 69, and the sensor components shown, for example, in FIG. 3. Beyond data usable for performing various simulations, the data provided can also include data necessary to determine an effect of mud channels in the casing string cement responsive to results of the cased hole pressure test.

A difference between the amount of additional fluid pumped into the drilling system and the amount of fluid returned defines a ballooning volume. As previously shown and described with respect to FIGS. 6B, 6D, 6F, and 11, the operation of performing a drilling system integrity and fracture pressure test can include determining a steady-state dynamic pressure adjacent the bottom hole of the wellbore, increasing pressure in the drilling system 22, detecting a loss in fluid volume greater than the ballooning volume, and determining fracture pressure responsive to detecting a loss in fluid volume to thereby determine a maximum dynamic pressure for the respective location of interest. Beyond data usable for performing various simulations, the data provided by both of the above tests can also include data necessary to determining a maximum dynamic bottom hole pressure at future depths to be drilled responsive to at least a portion of the local wellhead baseline data results to thereby enhance drilling requirements management.

The operation of predicting a value of the drilling fluid control variable for each of a plurality of weak points or other locations of interest can include the operations of establishing a desired bottom hole pressure responsive to a pressure level limitation for each location of interest, monitoring a drilling fluid mass and energy parameters in real-time for drilling fluid entering and exiting the drilling system 22, and executing a plurality of simulations using a corresponding plurality of drilling system simulators (see, e.g., FIG. 7) in response to the local well baseline data to determine for each of the locations of interest. The limitations can include a maximum pressure level, e.g., fracture or component maximum pressure, and a minimum pressure level, e.g., pore pressure, to support drilling operations.

The operation of controlling a drilling fluid parameter correspondingly can include includes the operation of modifying one or more of the drilling fluid parameters alone or in combination within the drilling string 17 and/or annulus 18 of the drilling system 22, to control the bottom hole pressure within constraints of each pressure level limitation for the locations of interest.

According to an embodiment of the present invention, also provided is a computer readable medium that is readable by a computer 67 controlling drilling fluid pressures in a drilling system 22, which can include instructions that, when executed by the computer, cause the computer to perform the operations of forming a pressure volume and pressure volume time curve describing a location of interest within a drilling system 22, detecting a change in fluid volume responsive to the pressure volume and pressure volume time curve and earth formation compressibility data including that for subsurface strata and pore fluids residing within the strata, and compressibility of the drilling fluid, and differentiating between drilling system component ballooning and lost circulation and between drilling system component breathing and a fluid kick when performing drilling operations. According to an embodiment of the computer readable medium, as described in more detail previously, the operation of forming a pressure volume and pressure volume time curves can include signaling a pump controller of a pressure pump 63 to pump additional fluid into the drilling system to thereby compress the drilling fluid, radially expand the casing string 47, 51, and conduit 41 and associated cement layers 49, 55, 43 and compress an earth formation surrounding the wellbore, and 10 measure over time an increase in fluid pressure and volume of fluid pumped into the drilling system.

This application relates to International Application No. PCT/US2006/025964 filed Jun. 30, 2006, U.S. Patent Application No. 60/701,744, filed on Jul. 22, 2005 and U.S. Patent Application No. 60/696,092, filed on Jul. 1, 2005, each incorporated herein by reference in its entirety.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the attached claims.

That claimed is:

1. A system for controlling drilling fluid attributes and parameters, the system comprising:

a drilling apparatus having at least one casing string cemented within a subterranean wellbore, a combination of the wellbore and the at least one casing string having a plurality of locations of interest located at separate locations;

a drilling string run within the at least one casing string;

an annulus formed between an external surface of the drilling string and inner surface of the innermost at least one casing string;

a drilling fluid inlet;

a drilling fluid outlet;

a drilling fluid circulating through the drilling fluid inlet, down through the drilling string, up through the annulus, and out the drilling fluid outlet;

at least one monitor positioned to monitor drilling fluid parameters of the drilling fluid entering the drilling string;

at least one monitor positioned to monitor drilling fluid parameters of the drilling fluid exiting the annulus;

an output port choke in communication with the annulus and the drilling fluid outlet;

a dynamic density control computer in communication with the choke and including a processor and memory associated with the processor to store operating instructions therein;

means for measuring expansion and compressibility of drilling fluid conducting drilling assembly components associated with drilling fluid circulation and compressibility of a surrounding earth formation to formulate a description of the physical behavior of the wellbore components;

means for performing a cased hole pressure test to determine a volume associated with expansion of pressurized drilling fluid carrying components of the drilling assembly during drilling operations;

means for performing an integrity and fracture pressure test to determine integrity of the cement sealing the at least one casing string to the wellbore and fracture pressure of an associated earth formation to thereby determine a dynamic maximum pressure that can exist at a lower end of the casing string without fracturing the associated earth formation or bonding of the cement; and dynamic density control program product stored in the memory of the dynamic density control computer and including instructions that when executed by the processor of the dynamic density control computer, cause the computer to perform the operations of:

determining separately for each of the plurality of separated locations of interest at least one drilling fluid control variable system limitation of a drilling fluid control variable, measuring a value of an operationally induced drilling fluid parameter at each of a plurality of separate locations when drilling, predicting separately for each of the plurality of separated locations of interest a value of the drilling fluid control variable responsive to each measured drilling fluid parameter value, and controlling a drilling fluid parameter responsive to each predicted control variable value and each associated at least one drilling fluid control variable system limitation.

2. A system as defined in claim 1, wherein the drilling assembly includes a riser, and wherein the cased hole pressure test includes determining a volume associated with expansion of the riser during drilling operations.

3. A system as defined in claim 1, further comprising:

means for detecting an influx into and a loss of drilling fluid from the drilling assembly during drilling operations; and means for differentiating between drilling assembly component breathing and a fluid kick responsive to detecting an influx of drilling fluid and between drilling assembly component ballooning and lost circulation responsive to detecting a loss of drilling fluid.

4. A system as defined in claim 1, further comprising:

a drilling fluid pump and pump controller with the dynamic density control computer positioned to adjust the pressure of the drilling fluid entering the drilling string to control dynamic pressure at at least one of the plurality of locations of interest responsive to determining approaching a limiting constraint; and wherein the operation of controlling dynamic pressure further includes the operation of adjusting at least one of the following: drilling fluid pump pressure, drilling fluid flow rate, drilling fluid temperature, drilling fluid gas composition, and fluid molecular concentration to thereby control dynamic fluid pressure of the drilling fluid.

5. A system as defined in claim 1, further comprising means for controlling one or more of the following: pressure, volume, density, temperature, fluid composition, and molecular concentration, for both single phase and multiphase drilling fluid when entering the drilling string, when exiting the annulus, and at a plurality of locations along a length inside the drilling string and in the annulus during drilling operations.

6. A system as defined in claim 1, wherein the at least one casing string is a plurality of casing strings each cemented in the wellbore;

wherein each location of interest includes at least one of the following: a specific weak point in at least one of the plurality of casing strings, a specific weak point in at least one cement layer surrounding one of the plurality of casing strings, a portion of an earth formation located at the bottom of the wellbore;

wherein the system further comprises a pressure sensitive device positioned adjacent a bottom hole of the wellbore to monitor and transmit pressure data to the dynamic density control computer during drilling operations; and wherein the operation of controlling a drilling fluid parameter the operation of controlling dynamic pressure simultaneously inside the drilling string, in the annulus, at the choke, and at the bottom of the wellbore.

7. A system as defined in claim 1, further comprising:

an inlet mixing chamber;

an inlet injection pump;

an outlet mixing chamber;

an outlet injection pump;

an inlet heating element associated with the mixing chamber and wherein the operation of controlling pressure of the drilling fluid includes performing one or more of the following operations:

adjusting the mass of the drilling fluid in the mixing chamber, adjusting the mass of the drilling fluid in the mixing chamber, and adjusting inert gas content of the drilling fluid in the mixing chamber.

8. A system as defined in claim 1, wherein the plurality of separated locations of interest comprise a plurality of laterally separated locations of interest.

9. A system for controlling drilling fluid attributes and parameters, the system comprising:

a drilling as apparatus having at least one casing string cemented within a subterranean wellbore, a combination of the wellbore and the at least one casing string having a plurality of locations of interest located at separate locations;

a drilling string run within the at least one casing string;

an annulus formed between an external surface of the drilling string and inner surface of the innermost at least one casing string;

a drilling fluid inlet;

a drilling fluid outlet;

a drilling fluid circulating through the drilling fluid inlet, down through the drilling string, up through the annulus, and out the drilling fluid outlet;

at least one monitor positioned to monitor drilling fluid parameters of the drilling fluid entering the drilling string;

at least one monitor positioned to monitor drilling fluid parameters of the drilling fluid exiting the annulus;

an output port choke in communication with the annulus and the drilling fluid outlet;

a pressure gauge positioned adjacent the drilling string to measure drilling fluid pressure during each test;

databases containing the following data in computer readable format accessible to the dynamic density control computer to formulate a description of the physical behavior of the wellbore components:

data indicating parameters of each stratae of earth formation associated with the wellbore, data indicating pore fluid quantifications within each stratae of earth formation, data indicating parameters of each casing string, data indicating parameters of each layer of cement associated with the wellbore, and data indicating parameters of the drilling fluid within the drilling string and annulus;

a dynamic density control computer in communication with the choke and including a processor and memory associated with the processor to store operating instructions therein; and dynamic density control program product stored in the memory of the dynamic density control computer and including instructions that when executed by the processor of the dynamic density control computer, cause the computer to perform the operations of:

determining separately for each of the plurality of separated locations of interest at least one drilling fluid control variable system limitation of a drilling fluid control variable, measuring a value of an operationally induced drilling fluid parameter at each of a plurality of separate locations when drilling, predicting a value of the drilling fluid control variable separately for each of the plurality of separated locations of interest responsive to each measured drilling fluid parameter value, controlling a drilling fluid parameter responsive to each predicted control variable value and each associated at least one drilling fluid control variable system limitation, measuring over time an increase in fluid pressure and volume of fluid pumped into the drilling apparatus, and generating at least one of the following: a pressure verses volume curve and a pressure verses volume versus time curve, determining a maximum dynamic bottom hole pressure at future depths to be drilled responsive to at least a portion of the data in the databases and at least one of a plurality of operational simulations to thereby enhance drilling requirements management, and determining an effect of mud channels in the casing string cement responsive to at least one of the simulations.

10. A system as defined in claim 9, wherein the plurality of separated locations of interest comprise a plurality of laterally separated locations of interest.

11. A system for controlling drilling fluid attributes and parameters, the system comprising:

a drilling apparatus having at least one casing string cemented within a subterranean wellbore, a combination of the wellbore and the at least one casing string having a plurality of locations of interest located at separate locations;

a drilling string run within the at least one casing string;

an annulus formed between an external surface of the drilling string and inner surface of the innermost at least one casing string;

a drilling fluid inlet;

a drilling fluid outlet;

a drilling fluid circulating through the drilling fluid inlet, down through the drilling string, up through the annulus, and out the drilling fluid outlet;

at least one monitor positioned to monitor drilling fluid parameters of the drilling fluid entering the drilling string;

at least one monitor positioned to monitor drilling fluid parameters of the drilling fluid exiting the annulus;

an output port choke in communication with the annulus and the drilling fluid outlet;

a test pump fluid reservoir;

a test pressure pump in fluid communication with an interior conduit of the drilling string and the test pump fluid reservoir to deliver test fluid under pressure to the drilling string to thereby simulate ballooning and breathing that occurs during drilling operations;

a flowmeter positioned in fluid communication between the test pressure pump and the drilling string to monitor a volume of the test fluid delivered to the drilling string;

a pressure gauge positioned in fluid communication with fluid output from the test pump to monitor a pressure of the test fluid delivered to the drilling string;

the fluid reservoir positioned to receive test fluid not lost to encroachment into a rock formation adjacent the lower end of the at least one casing string or cement associated with the at least one casing string, the total test fluid delivered by the test pump equal to test fluid attributable to ballooning plus test fluid lost due to encroachment;

a fluid reservoir level sensor positioned to sense an amount of the test fluid lost to encroachment indicated by a difference in a pre-test fluid level and a post-test fluid level;

a dynamic density control computer in communication with the choke and including a processor and memory associated with the processor to store operating instructions therein;

dynamic density control program product stored in the memory of the dynamic density control computer and including instructions that when executed by the processor of the dynamic density control computer, cause the computer to perform the operations of:

determining the volume of test fluid attributable to ballooning of the drilling apparatus components during drilling operations, determining at least one drilling fluid control variable system limitation of a drilling fluid control variable separately for each of the plurality of separated locations of interest, measuring a value of an operationally induced drilling fluid parameter at each of a plurality of separate locations when drilling, predicting a value of the drilling fluid control variable responsive to each measured drilling fluid parameter value separately for each of the plurality of separated locations of interest, and controlling a drilling fluid parameter responsive to each predicted control variable value and each associated at least one drilling fluid control variable system limitation.

12. A system as defined in claim 11, wherein the plurality of separated locations of interest comprise a plurality of laterally separated locations of interest.

13. A system for controlling drilling fluid attributes and parameters, the system comprising:

a drilling apparatus having at least one casing string cemented within a subterranean wellbore, a combination of the wellbore and the at least one casing string having a plurality of locations of interest located at separate locations;

a drilling string run within the at least one casing string;

an annulus formed between an external surface of the drilling string and inner surface of the innermost at least one casing string;

a drilling fluid inlet;

a drilling fluid inlet sensor positioned adjacent the drilling fluid inlet;

a drilling fluid bottom wellbore sensor positioned adjacent the bottom of the wellbore;

a drilling fluid outlet;

a drilling fluid outlet sensor positioned adjacent the drilling fluid outlet;

a drilling fluid circulating through the drilling fluid inlet, down through the drilling string, up through the annulus, and out the drilling fluid outlet;

at least one monitor positioned to monitor drilling fluid parameters of the drilling fluid entering the drilling string;

at least one monitor positioned to monitor drilling fluid parameters of the drilling fluid exiting the annulus;

an output port choke in communication with the annulus and the drilling fluid outlet;

a dynamic density control computer in communication with the choke and including a processor and memory associated with the processor to store operating instructions therein;

dynamic density control program product stored in the memory of the dynamic density control computer and including instructions that when executed by the processor of the dynamic density control computer, cause the computer to perform the operations of:

determining at least one drilling fluid control variable system limitation of a drilling fluid control variable separately for each of the plurality of separated locations of interest, measuring a value of an operationally induced drilling fluid parameter at each of a plurality of separate locations when drilling, to include measuring a value of an operationally induced drilling fluid parameter by the inlet sensor at the inlet, by the outlet sensor at the outlet, and by the bottom wellbore sensor, predicting a value of the drilling fluid control variable responsive to each measured drilling fluid parameter value separately for each of the plurality of separated locations of interest, and controlling a drilling fluid parameter responsive to each predicted control variable value and each associated at least one drilling fluid control variable system limitation; and one or more of the following simulators accessible to the dynamic density control program product to formulate a description of the physical behavior of the wellbore components:

a wellbore breathing, ballooning, and rebounding simulator positioned to account for expansion and contraction of the wellbore and surrounding volume under dynamic conditions, a hydraulics loop simulator positioned to determine frictional pressure drop for drilling fluid carrying components throughout the drilling assembly, a pressure control simulator positioned to provide data to control fluid kicks, a wellbore stability simulator positioned to determine fracture pressures and collapse pressures of adjacent earth formations, a hydraulics optimization simulator positioned to provide data to optimize hydraulic energy at a drill bit used to drill the wellbore, a drilling simulator positioned to determine rate of penetration parameters, a formation productivity simulator positioned to assess the production impairment due to drilling fluid invasion, and a geomechanics model positioned to provide data indicating how earth formations react with the drilling apparatus under varying conditions of pressure, temperature, density, and flow rate;

the operation of predicting a value for each control variable separately for each of the plurality of separated locations of interest including the operation of receiving by at least one of the simulators each measured drilling fluid parameter value and returning at least one predicted value.

14. A system as defined in claim 13, wherein the plurality of separated locations of interest comprise a plurality of laterally separated locations of interest.

15. A method of controlling drilling fluid parameters, the method comprising the steps of:

determining at least one drilling fluid control variable system limitation of a drilling fluid control variable separately for each of a plurality of separated locations of interest in a drilling system having at least one casing string cemented in a wellbore and a drilling string positionable therethrough, the step of determining including at least one of the following:

performing at least one cased hole pressure test prior to running the drilling string through the casing string to determine an amount of drilling fluid volume input into the drilling system attributable to ballooning during drilling operations, performing at least one cased hole pressure test after running the drilling string to determine an amount of drilling fluid volume input into the drilling system attributable to compression of the drilling string during drilling operations, each cased hole pressure test comprising the steps of:

filling the cased wellbore with fluid, sealing each drilling system fluid supply inlet and outlet, applying pressure to the fluid by pumping additional fluid into the drilling system by a pressure pump to thereby compress the drilling fluid, radially expand the casing string and associated cement layer, and compress an earth formation surrounding the wellbore, measuring over time an increase in fluid pressure and volume of fluid pumped into the drilling system, generating at least one of the following: a pressure verses volume curve and a pressure verses volume versus time curve, releasing the pressure to allow return of fluid, measuring an amount of fluid returning, and determining a difference between the amount of additional fluid pumped into the drilling system and the amount of fluid returned defining a balloon volume, the difference indicating at least one of the following: an amount of potential expansion of components of the drilling system due to a high pressure condition, an amount of potential contraction corresponding with removal of the high-pressure condition, and an amount of compressibility of the drilling string due to a high-pressure condition, and performing a drilling system integrity and fracture pressure test to determine integrity of cement sealing, the casing string to the wellbore to thereby determine a maximum pressure that can exist at the lower end of the casing string without fracturing and associated earth formation or bonding of the cement, to include:

drilling the wellbore below a lower end of the casing string, circulating drilling fluid through the drilling system, determining a steady-state dynamic pressure adjacent the bottom hole, increasing pressure in the drilling system, detecting a loss in fluid volume greater than the ballooning volume, and determining fracture pressure responsive to the detecting a loss in fluid volume to thereby determine a maximum dynamic pressure for the respective location of interest;

measuring a value of an operationally induced drilling fluid parameter at each of a plurality of separate locations when drilling;

determining an effect of mud channels in the casing string cement responsive to results of the cased hole pressure test;

predicting a value of the drilling fluid control variable separately for each of the plurality of separated locations of interest responsive to each measured drilling fluid parameter value; and controlling a drilling fluid parameter responsive to each predicted control variable value and each associated at least one drilling fluid control variable system limitation.

16. A method as defined in claim 15, wherein the controlled drilling fluid parameter is dynamic pressure, and wherein the step of controlling includes:

modifying fluid pressure of the drilling fluid delivered to the drilling fluid inlet real-time during drilling operations.

17. A method as defined in claim 15, wherein the controlled drilling fluid parameter is dynamic pressure, and wherein the step of controlling includes:

modifying pressure of the drilling fluid at both the drilling fluid inlet and the drilling fluid outlet or directly in the annulus during drilling operations.

18. A method as defined in claim 15, wherein the controlled drilling fluid parameter is dynamic pressure, and wherein the step of controlling includes modifying temperature of the drilling fluid delivered to the drilling fluid inlet.

19. A method as defined in claim 15, wherein the controlled drilling fluid parameter is dynamic pressure, and wherein the drilling fluid is a multiphase fluid, and wherein the step of controlling includes at least one of the following:

modifying inert gas content of the drilling fluid; and injecting or bleeding fluid directly from the annulus.

20. A method as defined in claim 15, wherein the drilling fluid is a primarily liquid drilling fluid, and wherein the step of controlling further includes:

modifying the density of the drilling fluid by supplying a gas to the primarily liquid drilling fluid to reduce dynamic pressure at at least one of the plurality of locations of interest.

21. A method as defined in claim 15, wherein the plurality of separated locations of interest comprise a plurality of laterally separated locations of interest.

22. A method of controlling drilling fluid parameters, the method comprising the steps of:

determining at least one drilling fluid control variable system limitation of a drilling fluid control variable separately for each of a plurality of separated locations of interest in a drilling system having at least one casing string cemented in a wellbore and a drilling string positionable therethrough, each location of interest including a separate wellbore component weak point, the step of determining including the step of establishing local wellhead baseline data separately for each of the plurality of separate wellbore component weak points, to include for each wellbore component weak point the steps of:

running a drilling string through the wellbore to account for compressibility of the drilling string when subjected to interior and exterior fluid pressure, filling at least a portion of the drilling system including the at least one casing string with fluid, sealing each drilling system fluid supply inlet and outlet, applying pressure to the fluid by pumping additional fluid into the drilling system by a pressure pump to thereby compress the drilling fluid, radially expand wellbore components of the drilling system, and compress an earth formation surrounding the wellbore, measuring over time a volume of fluid pumped into the drilling system and a corresponding increase in fluid pressure, generating at least one of the following: a pressure verses volume curve and a pressure verses volume versus time curve, releasing the pressure to allow return of fluid responsive to reaching a preselected pressure limitations, measuring an amount of fluid returning, and determining a difference between the amount of additional fluid pumped into the drilling system and the amount of fluid returned, the difference indicating at least one of the following: an amount of potential expansion of components of the drilling system due to a high pressure condition, an amount of potential contraction corresponding with removal of the high-pressure condition, and an amount of compressibility of a drilling system component due to a high-pressure condition;

measuring a value of an operationally induced drilling fluid parameter at each of a plurality of separate locations when drilling:

predicting a value of the drilling fluid control variable separately for each of the plurality of separated locations of interest responsive to each measured drilling fluid parameter value; the step of predicting including the steps of:

establishing a desired bottom hole pressure responsive to a pressure level limitation for each of the plurality of weak points, monitoring a plurality of drilling fluid mass and energy parameters in real-time for drilling fluid entering and exiting the drilling system, and executing a plurality of simulations using a corresponding plurality of drilling system simulators responsive to the local well baseline data to determine for each of the plurality of separate wellbore component weak points at least one of the following: a maximum pressure level and a minimum pressure level to support drilling operations;

controlling a drilling fluid parameter responsive to each predicted control variable value and each associated at least one drilling fluid control variable system limitation, to include the step of modifying at least one drilling fluid parameter within at least one of the following: a drilling string and an annulus of the drilling system, to control the bottom hole pressure within constraints of each pressure level limitation for the plurality of weak points; and determining a maximum dynamic bottom hole pressure at future depths to be drilled responsive to at least a portion of the local wellhead baseline data results to thereby enhance drilling requirements management.

23. A method as defined in claim 22, wherein the plurality of separated locations of interest comprise a plurality of laterally separated locations of interest.

24. A tangible computer readable medium that is readable by a computer controlling drilling fluid parameters in a drilling system, the computer readable medium storing a set of instructions that, when executed by the computer, cause the computer to perform the following operations, comprising:

determining at least one drilling fluid control variable system limitation of a drilling fluid control variable separately for each of a plurality of separated locations of interest in a drilling system having at least one casing string positioned in a wellbore and a drilling string positionable therethrough, the operation of determining including at least one of the following:

performing at least one cased hole pressure test prior to running the drilling string through the casing string to determine an amount of drilling fluid volume input into the drilling system attributable to ballooning during drilling operations, performing at least one cased hole pressure test after running the drilling string to determine an amount of drilling, fluid volume input into the drilling system attributable to compression of the drilling string during drilling operations, the operation of performing a cased hole pressure test comprising:

signaling a pump controller of a pressure pump to pump additional fluid into the drilling system to thereby compress the drilling fluid, radially expand the casing string and associated cement layer, and compress an earth formation surrounding the wellbore, measuring over time an increase in fluid pressure and volume of fluid pumped into the drilling system, generating at least one of the following: a pressure verses volume curve and a pressure verses volume versus time curve, signaling a pump controller of the pressure pump to cease pumping to allow return of fluid, measuring an amount of fluid returning, and determining a difference between the amount of additional fluid pumped into the drilling system and the amount of fluid returned, the difference indicating at least one of the following: an amount of potential expansion of components of the drilling system due to a high pressure condition, an amount of potential contraction corresponding with removal of the high-pressure condition, and an amount of compressibility of the drilling string due to a high-pressure condition, and performing a drilling system integrity and fracture pressure test to determine integrity of cement sealing the casing string to the wellbore to thereby determine a maximum pressure that can exist at the lower end of the casing string without fracturing and associated earth formation or bonding of the cement;

measuring a value of an operationally induced drilling fluid parameter at each of a plurality of separate locations when drilling;

predicting separately for each of the plurality of separated locations of interest a value of the drilling fluid control variable responsive to each measured drilling fluid parameter value; and controlling a drilling fluid parameter responsive to each predicted control variable value and each associated at least one drilling fluid control variable system limitation.

25. A computer readable medium as defined in claim 24, wherein the operation of controlling includes modifying fluid pressure of the drilling fluid delivered to a drilling fluid inlet for the drilling system inlet real-time during drilling operations.

26. A computer readable medium as defined in claim 24, wherein the controlled drilling fluid parameter is dynamic pressure, and wherein the operation of controlling includes modifying pressure of the drilling fluid at both the drilling fluid inlet and the drilling fluid outlet during drilling operations.

27. A computer readable medium as defined in claim 24, wherein the controlled drilling fluid parameter is dynamic pressure, and wherein the operation of controlling includes modifying temperature of the drilling fluid delivered to the drilling fluid inlet.

28. A computer readable medium as defined in claim 24, wherein the controlled drilling fluid parameter is dynamic pressure, and wherein the drilling fluid is a multiphase fluid, and wherein the operation of controlling includes modifying inert gas content of the drilling fluid.

29. A computer readable medium as defined in claim 24, wherein the drilling fluid is a primarily liquid drilling fluid, and wherein the operation of controlling further includes modifying the density of the drilling fluid by supplying a gas to the primarily liquid drilling fluid to reduce dynamic pressure at at least one of the plurality of locations of interest.

30. A computer readable medium as defined in claim 24, the operations further comprising determining an effect of mud channels in the casing string cement responsive to results of the cased hole pressure test.

31. A computer readable medium as defined in claim 24, wherein a difference between the amount of additional fluid pumped into the drilling system and the amount of fluid returned defines a ballooning volume, and wherein the operation of performing a drilling system integrity and fracture pressure test includes:

determining a steady-state dynamic pressure adjacent the bottom hole of the wellbore;

increasing pressure in the drilling system;

detecting a loss in fluid volume greater than the ballooning volume; and determining fracture pressure responsive to the detecting a loss in fluid volume to thereby determine a maximum dynamic pressure for the respective location of interest.

32. A computer readable medium as defined in claim 24, wherein the plurality of separated locations of interest comprise a plurality of laterally separated locations of interest.

33. A tangible computer readable medium that is readable by a computer controlling drilling fluid parameters in a drilling system, the computer readable medium storing a set of instructions that, when executed by the computer, cause the computer to perform the following operations, comprising:

determining at least one drilling fluid control variable system limitation of a drilling fluid control variable separately for each of a plurality of separated locations of interest in a drilling system having at least one casing string positioned in a wellbore and a drilling string positionable therethrough, each location of interest including a separate wellbore component weak point, the operation of determining including the operation of establishing local wellhead baseline data separately for each of the plurality of separate wellbore component weak points, the operation of establishing local wellhead baseline data including for each wellbore component weak point:

signaling a pump controller of a pressure pump to pump additional fluid into the drilling system to thereby compress the drilling fluid, radially expand the casing string and associated cement layer, and compress an earth formation surrounding the wellbore, measuring over time an increase in fluid pressure and volume of fluid pumped into the drilling system, generating at least one of the following: a pressure verses volume curve and a pressure verses volume versus time curve, signaling a pump controller of the pressure pump to cease pumping to allow return of fluid, measuring an amount of fluid returning, determining a difference between the amount of additional fluid pumped into the drilling system and the amount of fluid returned, the difference indicating at least one of the following: an amount of potential expansion of components of the drilling system due to a high pressure condition, an amount of potential contraction corresponding with removal of the high-pressure condition, and an amount of compressibility of the drilling string due to a high-pressure condition, and determining a volume of fluid associated with a volume reduction due to compressibility of the drilling string when positioned in the wellbore and when subjected to interior and exterior fluid pressure;

measuring a value of an operationally induced drilling fluid parameter at each of a plurality of separate locations when drilling;

predicting separately for each of the plurality of separated locations of interest a value of the drilling fluid control variable responsive to each measured drilling fluid parameter value;

the operation of predicting including the operations of:

establishing a desired bottom hole pressure responsive to a pressure level limitation for each of the plurality of weak points, monitoring a plurality of drilling fluid mass and energy parameters in real-time for drilling fluid entering and exiting the drilling system, and executing a plurality of simulations using a corresponding plurality of drilling system simulators responsive to the local well baseline data to determine for each of the plurality of separate wellbore component weak points at least one of the following: a maximum pressure level and a minimum pressure level to support drilling operations; and controlling a drilling fluid parameter responsive to each predicted control variable value and each associated at least one drilling fluid control variable system limitation, to include the operation of modifying at least one drilling fluid parameter within at least one of the following: a drilling string and an annulus of the drilling system, to control the bottom hole pressure within constraints of each pressure level limitation for the plurality of weak points.

34. A computer readable medium as defined in claim 33, the operations further comprising determining a maximum dynamic bottom hole pressure at future depths to be drilled responsive to at least a portion of the local wellhead baseline data results to thereby enhance drilling requirements management.

35. A computer readable medium as defined in claim 33, wherein the plurality of separated locations of interest comprise a plurality of laterally separated locations of interest.

* * * * *

UNITED STATES PATENT AND TRADEMARK OFFICE

CERTIFICATE OF CORRECTION

PATENT NO. : 7,908,034 B2
APPLICATION NO. : 11/994320
DATED : March 15, 2011
INVENTOR(S) : Kenneth E. Gray It is certified that error appears in the above-identified patent and that said Letters Patent is hereby corrected as shown below:

In the specification:

On Column 4, line 18, delete “weal” and after “specific” insert --weak--;

On Column 15, line 41, delete “Known” and after “is” insert --known--.

In the claims:

On Column 23, claim 9, line 11, after “drilling” delete “as”.

Signed and Sealed this
Thirty-first Day of May, 2011

David J. Kappos

David J. Kappos
*Director of the United States Patent and Trademark Office*